US006651975B2

(12) United States Patent
Ohtsuka et al.

(10) Patent No.: US 6,651,975 B2
(45) **Date of Patent: *Nov. 25, 2003**

(54) SHEET PACK AND PRINTER

(75) Inventors: Kuniaki Ohtsuka, Yokohama (JP); Seiji Takahashi, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 30 days.

(21) Appl. No.: 09/220,069

(22) Filed: Dec. 23, 1998

(65) Prior Publication Data

US 2001/0011795 A1 Aug. 9, 2001

(30) Foreign Application Priority Data

Dec. 24, 1997 (JP) ..... 9-355859
Dec. 4, 1998 (JP) ..... 10-346138

(51) Int. Cl.[7] ..... G03B 27/00

(52) U.S. Cl. ..... 271/145; 271/258.04; 271/265.01; 271/264; 355/407

(58) Field of Search ..... 271/264, 145, 271/258.04, 265.01

(56) References Cited

U.S. PATENT DOCUMENTS 3,635,334 A * 1/1972 Collins ..... 206/216
4,660,722 A * 4/1987 Poehler ..... 206/454
5,067,835 A * 11/1991 Yamamoto et al. ..... 400/582
5,253,941 A * 10/1993 Kamoda ..... 400/692
5,633,670 A * 5/1997 Kwak ..... 347/188
6,246,466 B1 * 6/2001 Hirano et al. ..... 355/407

* cited by examiner

*Primary Examiner*—Donald P. Walsh
*Assistant Examiner*—Jonathan R Miller
(74) *Attorney, Agent, or Firm*—Fitzpatrick, Cella, Harper & Scinto

(57) ABSTRACT

Disclosed are a sheet pack and a printer, the sheet pack being inexpensive and capable of being easily set onto the printer and simply exchanged with another one, while users can know information such as the quality, size and number of sheets of printing paper contained in the sheet pack. The sheet pack, containing a predetermined number of sheets, has a frame case formed of thick paper, and may include a sheet supply opening, an abutment opening, a pressure contact opening and a separating pad. A recording member for recording information such as quality, size, number, thickness, color or production date of sheets contained in the sheet pack, may also be provided on the sheet pack. The printer, onto which the sheet pack can be removably set includes an information reading unit for reading the information recorded in the recording member when the sheet pack is set onto the printer. The information read by the information reading unit is displayed by a display unit. The number of sheets remained in the sheet pack resulted from subtracting the number of sheets printed from the original number of sheets may also be recorded in the recording member.

8 Claims, 26 Drawing Sheets

SHEET PACK AND PRINTER

BACKGROUND OF THE INVENTION

1. Field of the Invention

The present invention relates to a printer connected to, e.g., information terminal apparatus such as a personal computer, an image sensing device, a TV set and a set top box for printing data transmitted from the information terminal apparatus. More particularly, the present invention relates to a sheet pack which can be removably set onto a printer, and contains sheets of printing paper in stacked form, and to the printer including the sheet pack set onto it.

2. Description of the Related Art

Hitherto, in a printer connected to a personal computer or an image sensing device for printing data transmitted from the personal computer or the image sensing device on a sheet of printing paper, it has been customary to start printing by opening a package containing a bundle of sheets of printing paper and setting the sheets to a sheet inlet of the printer one by one, or stacking a desired number of sheets of printing paper in a sheet feeding portion of the printer. Containing unit (so-called sheet cassette) for containing sheets of printing paper in stacked form is removably set onto a printer body. When a user starts printing by setting the sheet cassette onto the printer body, the user places sheets of printing paper in the sheet cassette and then sets the sheet cassette to a cassette attachment slot formed in the printer body.

After the sheet cassette has been set to the cassette attachment slot, the sheets of printing paper contained in the sheet cassette in stacked form are separated and fed one by one to a recording section inside the printer body by a sheet supply roller, a separating pad, etc.

In any of the conventional printers described above, however, there has been a problem of inconvenience to a user because the user must open a package containing a bundle of sheets of printing paper and set the sheets to the sheet inlet of the printer one by one, or take out a required number of sheets of printing paper from the opened package and stack the sheets in the sheet feeding portion of the printer.

A problem of inconvenience to a user has also been experienced in the printer of the type removably setting a sheet cassette onto the printer body because the user must remove the sheet cassette from the printer body and then set the sheet cassette back to the cassette attachment slot after opening a package containing a bundle of sheets of printing paper, taking out a required number of sheets of printing paper from the opened package, and placing the sheets in the sheet cassette as with the above case.

When a random number of sheets of printing paper are contained in the sheet cassette, the user can know neither the number of sheets of printing paper contained in the sheet cassette at the start of printing nor the number of sheets of printing paper remaining in the sheet cassette at the present time. Therefore, the sheets of printing paper may be completely depleted during the printing. If this occurs, the user must repeat the same operation as described above again, i.e., the user must remove the sheet cassette from the printer body and then set the sheet cassette back to the cassette attachment slot after opening the package containing a bundle of sheets of printing paper, taking out a required or random number of sheets of printing paper from the opened package, and placing the sheets in the sheet cassette. In addition, the user must instruct the operation to continue the printing to the printer body or the information terminal apparatus, e.g., the personal computer. This has been very inconvenient to users.

Further, the printer body or the information terminal apparatus for transmitting data to the printer cannot identify the quality of printing paper. This raises another problem that even where sheets of printing paper not adapted for the purpose of printing or printed data are contained in the sheet pack, or stacked in the sheet feeding portion, or set to the sheet inlet, those sheets are fed as they are for printing and a desired printing result cannot be obtained.

Still another problem is that because the printer body or the information terminal apparatus for transmitting data to the printer cannot identify the sheet size of printing paper, the data may be printed on a sheet of printing paper whose size is different from the desired one, and a desired printing result cannot be obtained.

SUMMARY OF THE INVENTION

With the view of solving the above-mentioned problems in the related art, an object of the present invention is to provide a sheet pack which contains a bundle of sheets of printing paper and can be directly and easily set onto a printer with no need of opening a package containing a bundle of sheets of printing paper and taking out some of the sheets from the package. Another object of the present invention is to provide a sheet pack which can transmit, to a printer, information such as the quality, size, color and number of sheets of printing paper contained in the sheet pack. Still another object of the present invention is to provide a printer which can receive the sheet pack and can read the information transmitted from the sheet pack.

To achieve the above object, the present invention provides a sheet pack containing a predetermined number of sheets of printing paper, wherein a sheet supply opening for supplying the sheets to a printer body through the same is formed at one surface of the sheet pack, a first opening, through which a sheet supply rotating member on the printer body side is allowed to come into contact with the sheet when the sheet pack is set onto the printer body, is formed in another surface of the sheet pack, and a second opening, through which sheet lifting means on the printer body side is allowed to enter the sheet pack when the sheet pack is set onto the printer body, is formed in still another surface of the sheet pack.

According to another feature of the present invention, an outer casing of the sheet pack is partly capable of opening and closing.

According to still another feature of the present invention, the sheet pack includes a recording member recording the quality, size, thickness, color, number and/or production date of sheets contained in the sheet pack.

Also, to achieve the above object, the present invention provides a printer connected to an information terminal apparatus, etc. for printing data transmitted from the information terminal apparatus, etc. on a sheet of printing paper, the printer comprising attachment means to which the above-mentioned sheet pack is set, information reading means for reading the information recorded in the recording member when the print pack is set to the attachment means, and information transmitting means for transmitting the information read by the information reading means to the information terminal apparatus, etc.

Further, according to the present invention, in a printer onto which a sheet pack containing sheets of printing paper is removably set, the sheet pack including recording member recording the quality, size, thickness, color, number and/or production date of sheets contained therein, the printer comprises reading means for reading the information recorded in the recording member when the print pack is set, and information transmitting means for transmitting the information read by the reading means to an information terminal apparatus connected to the printer. The information read by the reading means is displayed on a display unit in the printer, or the transmitted information is displayed on the information terminal apparatus.

DETAILED DESCRIPTION OF THE PREFERRED EMBODIMENTS

Preferred embodiments of the present invention will be described below with reference to the drawings.

Figure 1:
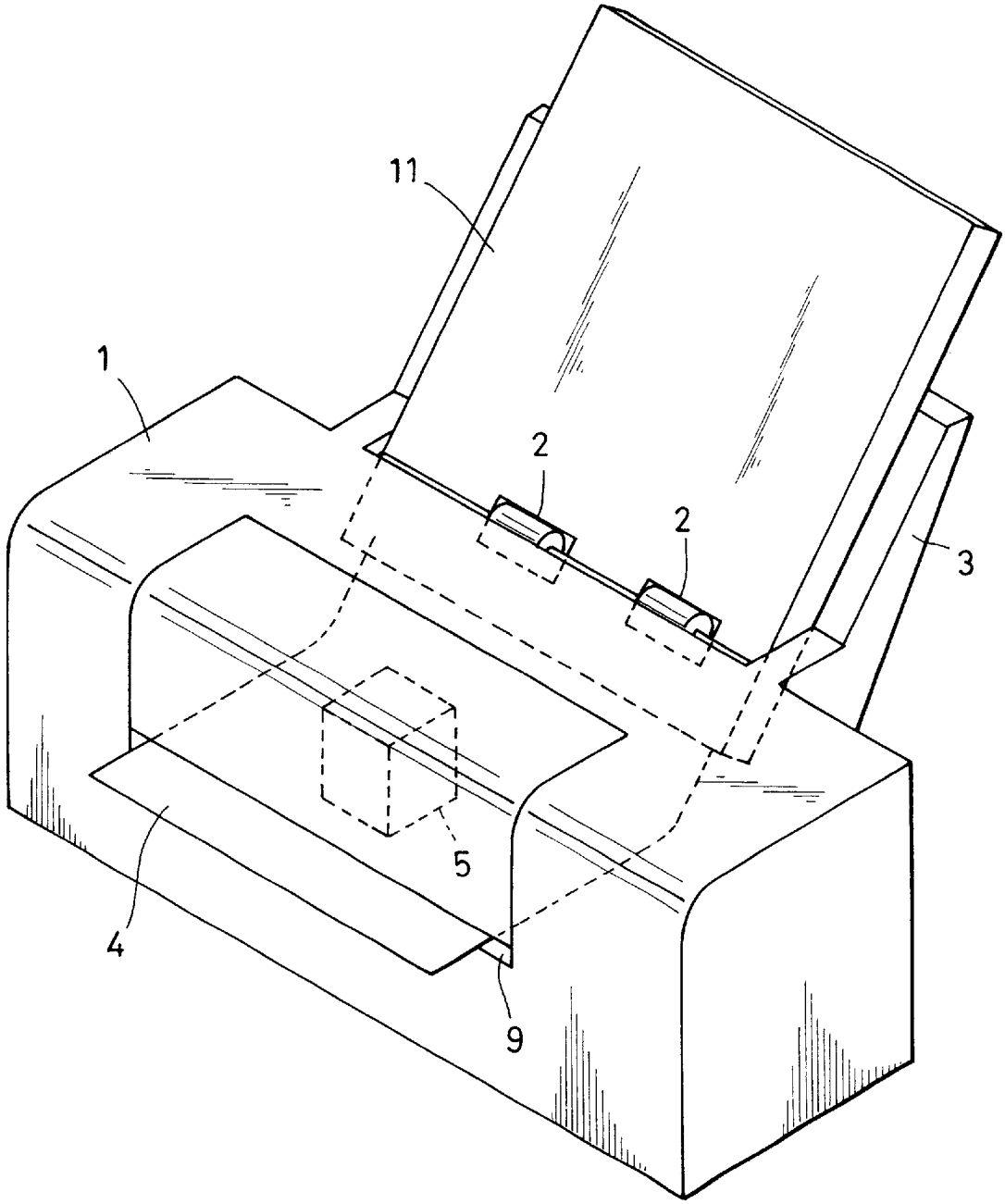
FIG. 1 is a perspective view of a printer according to a first embodiment of the present invention.

FIG. 1 is a perspective view of a printer and a sheet pack according to a first embodiment of the present invention.

In FIG. 1, reference numeral 1 denotes a printer, 2 denotes a sheet supply roller, 11 denotes a sheet pack containing sheets of printing paper in stacked form, 3 denotes an attachment portion (sheet supply stand) provided to extend from an upper surface of the printer 1 on the rear side for receiving the sheet pack 11 in a removable manner, 4 denotes a sheet of printing paper supplied from the sheet pack 11 to the interior of the printer 1, 5 denotes a print head having print nozzles (not shown) formed on the underside of the print head 5, and 9 denotes a sheet outlet.

When printing data on the sheet 4 of printing paper, the sheet 4 is supplied from the sheet pack 11, which is set to the attachment portion 3, by the sheet supply rollers 2 to a printing region, and it then passes under the print nozzles of the print head 5 while the data is printed on the sheet. The sheet 4 of printing paper on which the data has been printed is discharged through the sheet outlet 9.

Figure 2:
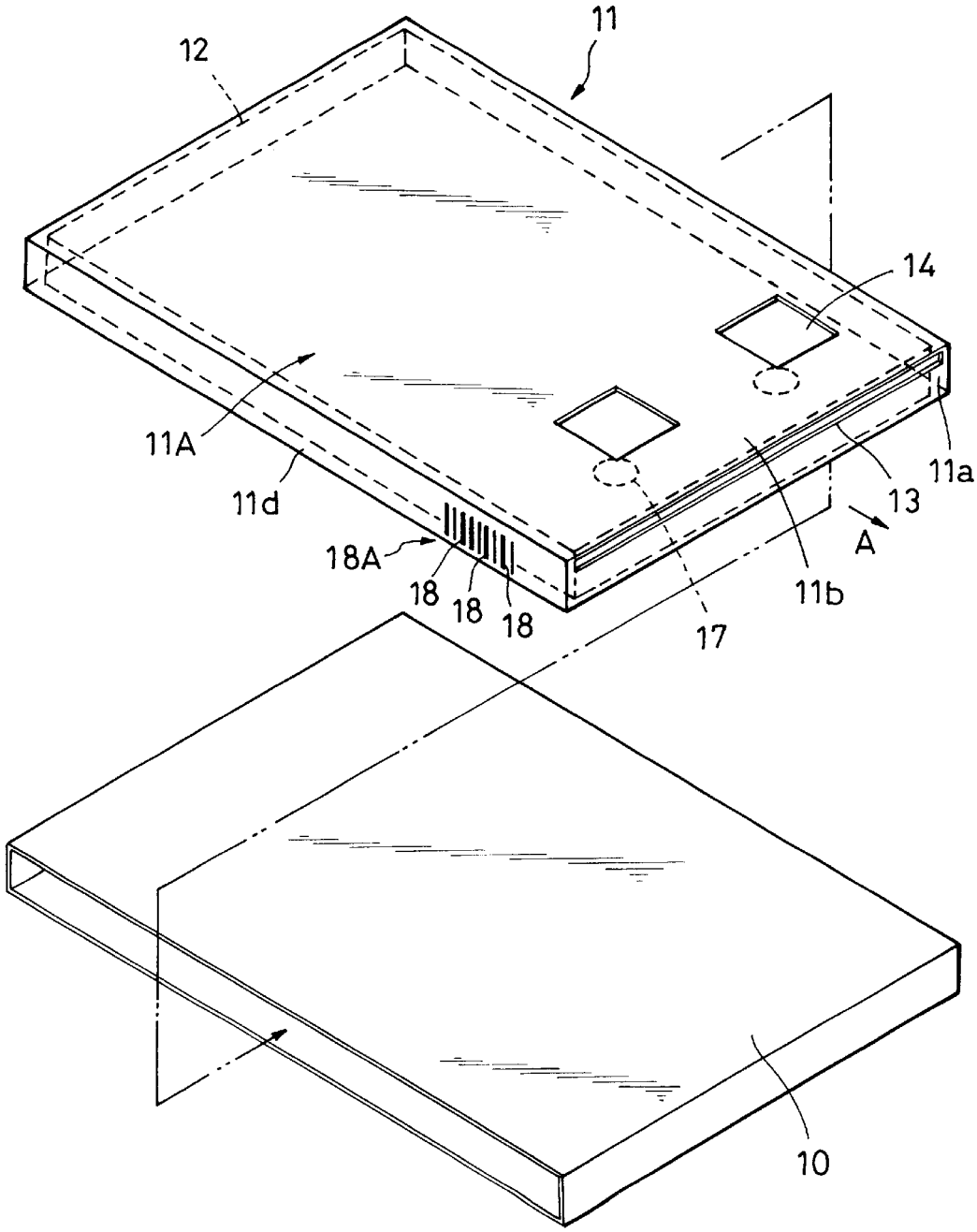
FIG. 2 is a perspective view of a sheet pack set onto the printer.
Figure 3A:
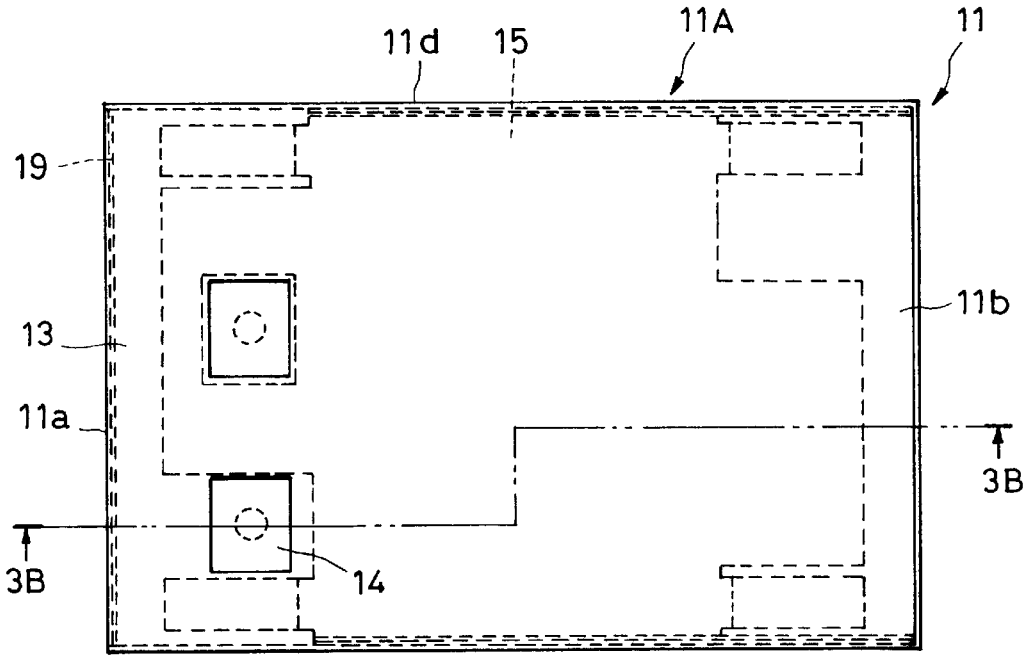
FIG. 3A is a plan view of the sheet pack.
Figure 3B:
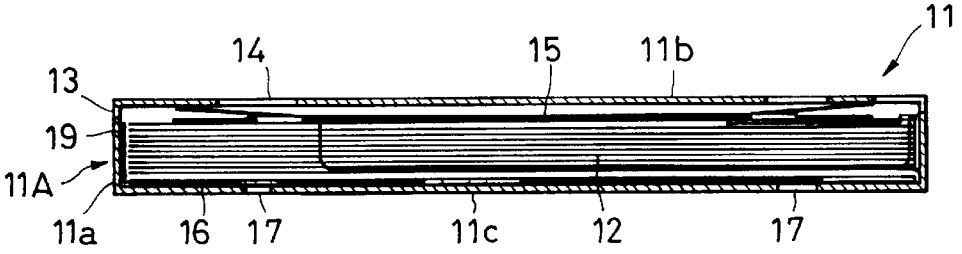
FIG. 3B is a sectional view taken along line A—A in FIG. 3A.

FIG. 2 is a perspective view of the sheet pack 11, FIG. 3A is a plan view of the sheet pack 11, and FIG. 3B is a sectional view taken along line A—A in FIG. 3A.

In FIGS. 2 and 3B, reference numeral by 12 denotes a bundle of sheets of printing paper contained in the sheet pack 11. Here, the sheet pack 11 contains the bundle 12 of sheets including the sheets of printing paper in a predetermined number, e.g., 100, and can be simply set to the printer 1 with no need of opening package containing sheets of printing paper and taking out some of the sheets as required in the related art. Using the sheet pack 11 is also advantageous in eliminating a fear that finger prints may be put on the sheets, or the sheets may be stained or folded.

Reference numeral 13 denotes a sheet supply opening formed in an end surface 11*a* of a frame 11A of the sheet pack 11, which locates on the head side in a direction of sheet feeding, for allowing the sheets 4 of printing paper to be supplied from the bundle 12 of sheets one by one through it, and 14 denotes an abutment opening (first opening) formed in an upper surface 11*b* of the frame 11A for allowing the sheet supply roller 2 of the printer 1 to come into abutment with the top one of the sheets 4 of printing paper when the sheet pack 11 is set onto the printer.

Further, reference numeral 15 denotes a leaf spring provided inside the sheet pack 11 to serve as means for urging the sheets 4 of printing paper in the bundle 12 to retract from the sheet supply rollers 2 when the sheets are not supplied to the printer 1, 16 denotes a pressure plate for bringing the bundle 12 of sheets into pressure contact with the sheet supply rollers 2 when the sheets are supplied to the printer 1, 17 denotes a pressure contact opening (second opening) formed in a bottom wall 11*c* of the frame 11A so that a later-described pressing lever on the side of the printer 1 is allowed to enter the sheet pack 11 through the pressure contact opening 17 for bringing the top one of the sheets 4 of printing paper into abutment with the sheet supply rollers 2, and 19 denotes a separating pad provided on a surface of the pressure plate 16 facing the sheets 4 of printing paper to serve as a sheet separating mechanism capable of separating the sheets individually with the aid of friction. The leaf spring 15 is disposed on the same side of the bundle 12 of sheets as the sheet supply opening 13, and the pressure plate 16 is disposed on the opposite side of the bundle 12 of sheets.

When the sheet supply operation is not effected, or when the sheet pack 11 is removed from the printer 1, the sheets 4 of printing paper contained in the sheet pack 11, which is constructed as described above, are kept from coming out through the sheet supply opening 13 because the bundle 12 of sheets is urged by resiliency of the leaf spring 15 toward the side opposite to the sheet supply opening 13. On the other hand, when the pressure plate 16 is pressed by the later-described pressing levers coming into the sheet pack 11 through the pressure contact openings 17 at the time of supplying the sheets, the fore end of the bundle 12 of sheets is lifted against the resiliency of the leaf spring 15 to face the sheet supply opening 13 of the sheet pack 11.

Additionally, reference numeral 10 denotes an aid case fitted over the sheet pack 11 to cover the sheet supply opening 13, the abutment openings 14 and the pressure contact openings 17 for protecting the sheets 4 of printing paper against dust, extraneous light, temperature, humidity, finger prints, etc. when the sheet pack 11 is removed from the printer 11 or before the sheet pack 11 is set onto the printer 1.

Also, by using thick paper as materials to form the frame (package) 11A of the sheet pack 11 and the aid case 10, these products can be manufactured at a lower cost and can be easily discarded by users after the sheets of printing paper contained in the sheet pack are all used up. Moreover, it is also possible to recover the sheet pack 11 and the aid case 10 for reuse.

Referring further to FIG. 2, reference numeral 18A denotes a bar code provided as one example of an information recording member on one side surface 11*d* of the frame 11A of the sheet pack 11. Information such as the quality, size and number of sheets 4 of printing paper contained in the sheet pack 11 is recorded in combinations of code bars 18 constituting the bar code 18A. For example, the bar code 18A on the sheet pack 18 containing 100 sheets of ordinary printing paper in A4 size records in combinations of the code bars 18 beforehand such information that paper quality is ordinary, that the sheet size is A4, and that the number of sheets is 100.

As described above, the sheet pack 11 is a kind of package containing a predetermined number of sheets of printing paper, and transported from the maker's factory to a user in the form of itself. The user can set the sheet pack 11 as it is into the sheet supply stand of the printer without tearing the sheet pack to open it. In other words, the sheet pack functions as a case for carrying, storing and supplying the sheets of printing paper.

Figure 4:
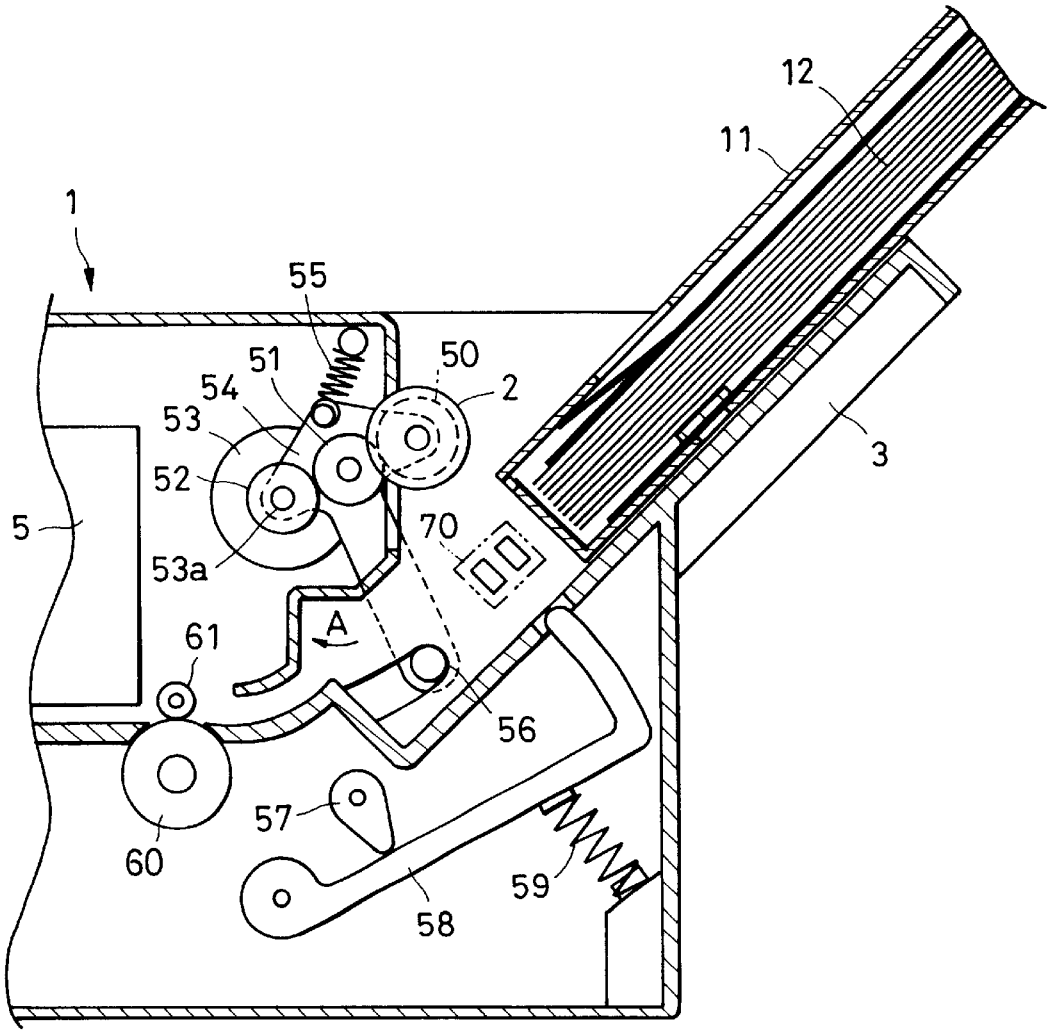
FIG. 4 is a partial sectional view for explaining the construction of a printer.
Figure 5:
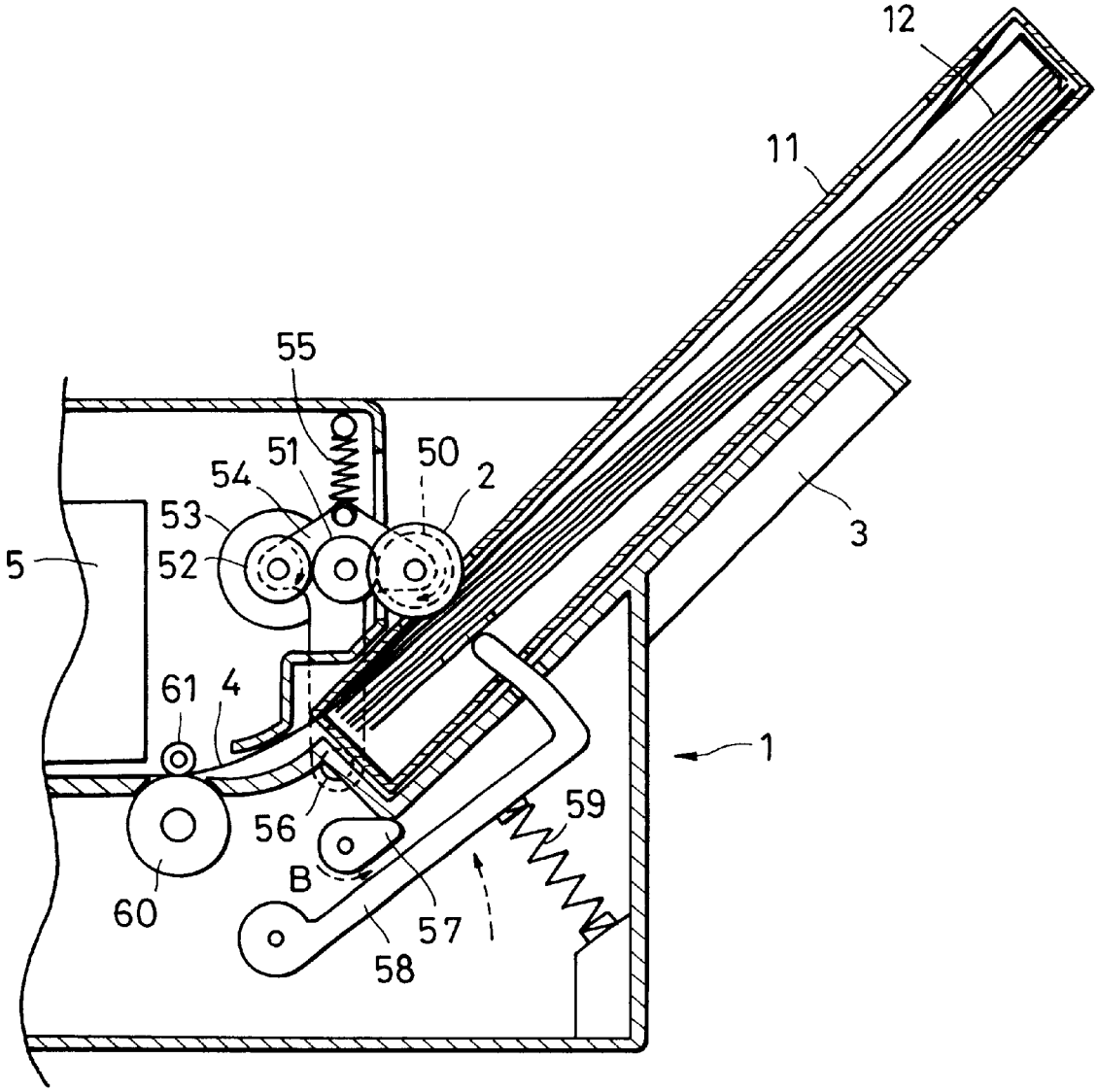
FIG. 5 is a partial sectional view showing a state where the sheet pack is set onto the printer.
Figure 6:
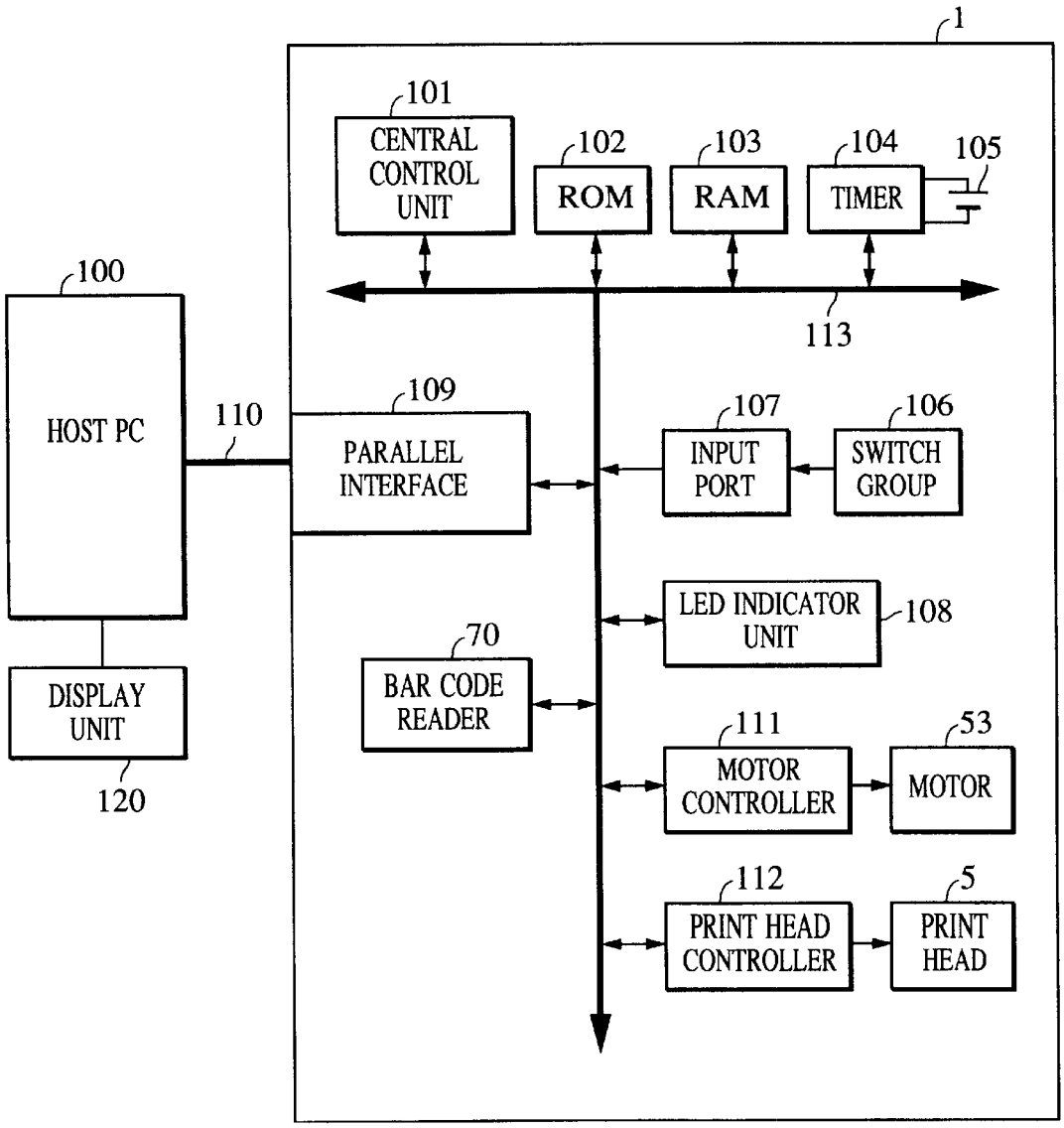
FIG. 6 is a block diagram of the printer and a host PC.

FIGS. 4 to 6 are each a partial sectional view for explaining the construction of the printer 1.

In FIGS. 4 and 5, reference numeral 54 denotes a sheet supply lever actuated in interlock with insertion of the sheet pack 11 to swing the sheet supply roller 2 toward the sheet pack 11, and 55 denotes a spring for urging the sheet supply roller 2 in interlock with removal of the sheet pack 11 in a direction to retract from the sheet pack 11. Also, reference numeral 53 denotes a motor for rotating the sheet supply roller 2. The rotation of the motor 53 is transmitted to a sheet supply gear 50 of the sheet supply roller 2 through a train of gears 52 and 51 provided on the sheet supply lever 54, whereupon the sheet supply roller 2 is rotated.

The sheet supply lever 54 is free to swing about the center of a motor shaft 53*a*, and is normally urged by a spring 55 in the counterclockwise direction. Thus, when the sheet pack 11 is not set, the sheet supply roller 2 is retracted to a position shown in FIG. 4 where it does not interfere with insertion of the sheet pack 11.

The sheet supply lever 54 is provided at its lower end with a pin 56 which is pressed by the sheet pack 11 when the sheet pack 11 is set in place. Upon the pin 56 being pressed by the sheet pack 11, the sheet supply lever 54 swings in the direction of arrow A in FIG. 4, causing the sheet supply roller 2 to enter the abutment opening 14 of the sheet pack 11 and come into abutment with the top one of the sheets 4 of printing paper, as shown in FIG. 5.

Further, in FIGS. 4 and 5, reference numeral 60 denotes a feed roller for feeding the sheet 4 of printing paper supplied from the sheet pack 11, and 61 denotes a pinch roller for pinching the sheet 4 of printing paper between itself and the feed roller 60. As shown in FIG. 5, these two rollers 60, 61 cooperate to pinch and feed the sheet 4 of printing paper to a printing region which is positioned to face the print head 5. Data is printed on the sheet 4 of printing paper fed to the printing region, and the printed sheet 4 is then discharged through the sheet outlet 9 shown in FIG. 1.

Reference numeral 58 denotes a pressing lever for pushing up the pressure plate 16 in the sheet pack 11, 57 denotes a cam rotated by a drive motor (not shown) to swing the pressing lever 58, and 59 denotes a spring for urging the pressing lever 58 in the direction of pressing the bundle 12 of sheets.

The cam 57 holds the pressing lever 58 in a position, shown in FIG. 4, out of interference with insertion of the sheet pack 11 before the sheet pack 11 is set in place, while it is turned by the drive motor in the direction of arrow B shown in FIG. 5 when the sheets are supplied, so that the pressing lever 58 is turned upward to come into the sheet pack 11 through the pressure contact opening 17. Upon the pressure plate 16 being pushed up by the pressing levers 58, the fore end of the bundle 12 of sheets is lifted to face the sheet supply opening 13 of the sheet pack 11.

In FIG. 4, reference numeral 70 denotes a bar code reader for reading information about the sheets 4 of printing paper that is recorded in the bar code 18A provided on one side surface of the sheet pack 11. The bar code reader 70 is provided in a position to face the bar code 18A on the sheet pack 11 when it is inserted.

The information read by the bar code reader 70 is stored in the printer 1. The stored information is transmitted from the printer 1 to a host PC 100 shown in FIG. 6, and then displayed on a display unit 120 of the host PC 100.

Referring now to FIG. 6, reference numeral 101 denotes a central control unit for controlling the entirety of the printer 1, 102 denotes a ROM for storing programs read by the central control unit 101 to control associated components, 103 denotes a RAM in which print data is temporarily stored and which serves as a work area storing data written or read by the central control unit 101, 104 denotes a timer used, as needed, by the central control unit 101 for counting time, and 105 denotes a cell for allowing the timer 104 to continue counting of time even while a not-shown power supply is turned off.

Also, reference numeral 106 denotes a switch group including a reset switch, a sheet discharge switch, etc. used for direct operation of the printer 1, 107 denotes an input port for transmitting a digital data to inform the central control unit 101 of any of the switches being depressed, 108 denotes an LED indicator unit indicating the status of the printer 1 and controlled to turn on/off by the central control unit 101, 111 denotes a motor controller for driving the motor 53 in accordance with an instruction from the central control unit 101, and 112 denotes a print head controller for driving the print head 5 in accordance with an instruction from the central control unit 101.

Further, reference numeral 110 denotes a parallel cable for connecting the printer 1 and the host PC 100 to each other, 109 denotes a parallel interface through which print data and control signals are received from the host PC 100 via the parallel cable 110 and status signals are transmitted from the printer 1, and 113 denotes an internal bus for interconnecting the associated components to transfer data signals and address signals among them.

Figure 7:
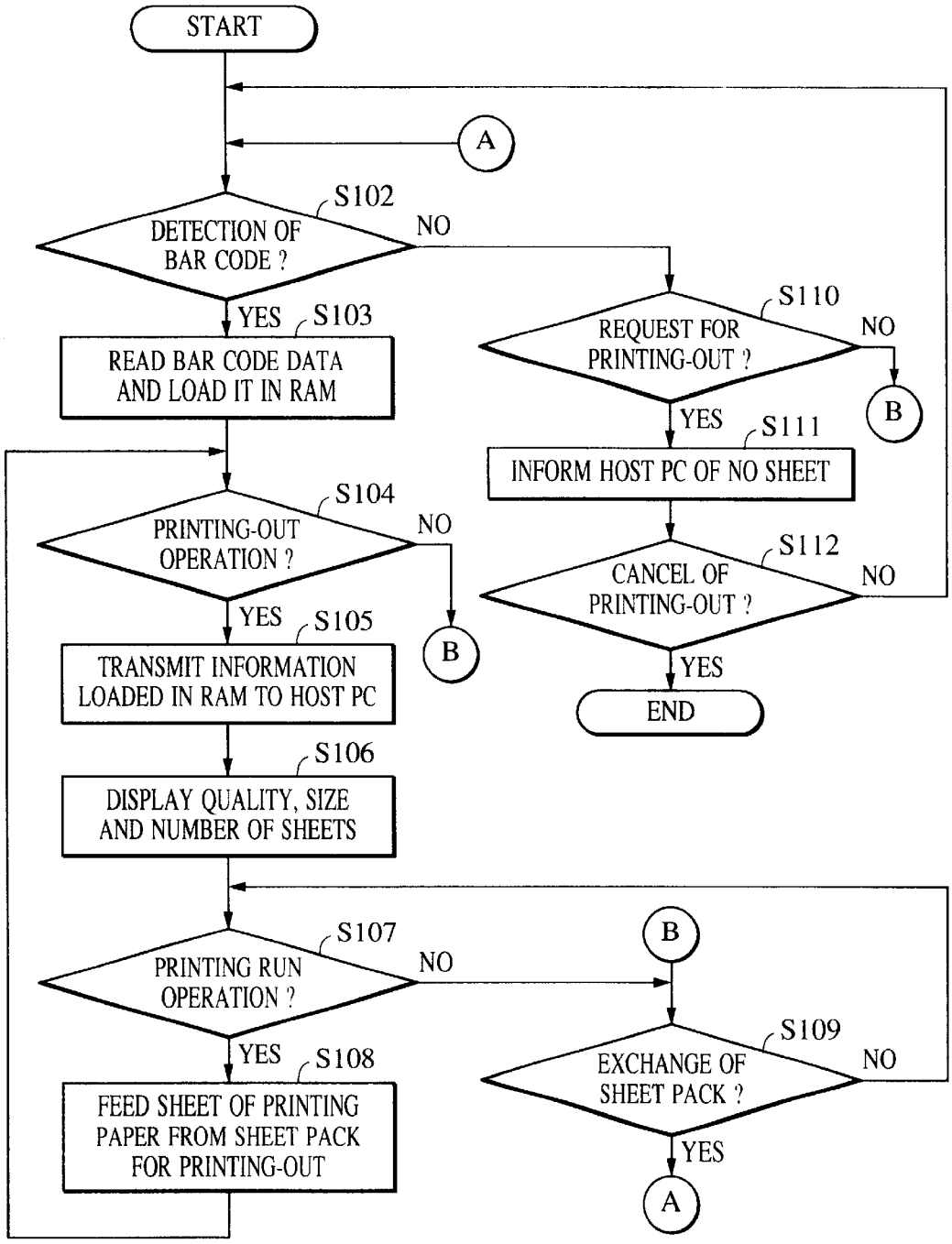
FIG. 7 is a flowchart for explaining the information reading operation and the display operation executed by the printer and the host PC.

The information reading operation and the display operation executed by the printer and the host PC, which have the above-described construction, will be described below with reference to a flowchart of FIG. 7.

First, when the sheet pack 11 shown in FIGS. 2, 3A and 3B is set onto the printer 1, as shown in FIG. 1, and the bar code 18A reaches a position facing the bar code reader 70, the bar code reader 70 detects the bar code 18A (represented by YES of S102) and outputs a detected signal to the central control unit 101. Then, the central control unit 101 reads bar code data recorded in the bar code 18A based on the detected signal from the bar code reader 70, and loads the read data in the RAM 103 (S103).

After that, if printing-out key-in operation to instruct printing-out or print setting is executed on the host PC 100 during the operation of certain application software (represented by YES of S104), printer driver software for setting control of the printer 1 or transmitting print data to the printer 1 in a handshaking manner is started up, whereupon the host PC 100 transmits a request for printing-out to the printer 1 via the parallel cable 110.

Upon receiving the request signal, the central control unit 101 transmits the data, which is loaded in the RAM 103, to the host PC 100 via the parallel interface 109 and the parallel cable 110 (S105). Then, the host PC 100 displays the transmitted data such as the quality, size and number of sheets 4 of printing paper (S106).

The user then determines, based on the displayed information, that the quality, size and number of sheets 4 of printing paper contained in the sheet pack 11 are desired ones, and then performs the printing run key-in operation to instruct execution of printing (represented by YES of S107). This causes the print data to be transmitted from the printer driver software to the printer 1 via the parallel cable 110.

In accordance with the transmitted print data, the central control unit 101 drives the motor 53 through the motor controller 111 to rotate the sheet supply rollers 2, causing the sheets 4 of printing paper to be supplied from the sheet pack 11 into the printer, and also drives the print head 5 through the print head controller 112 to execute the printing-out (S108).

On the other hand, if the quality, size or number of sheets 4 of printing paper contained in the sheet pack 11 is determined in step S107 not to be the desired one, then the user may exchange the sheet pack 11 for a desired one. For example, if the sheet pack 11 does not contain sheets of special coating paper, but instead contains sheets of ordinary paper, when photographic data is to be printed out, the user removes the sheet pack 11, which is set at that time, out of the printer 1 for exchange with another sheet pack 11 which contains sheets of special coating paper, but has exactly the same shape as the sheet pack 11 containing sheets of ordinary paper (S109).

If the sheet pack 11 is exchanged with another one (represented by YES of S109), the same sequence as that from step S102 to S106 is repeated to read bar code data, transmit the read data, and display such a message on the host PC 100 as indicating that the sheets of special coating paper are set.

Then, if the printing run key-in operation is made in the above state (represented by YES of S107), the print data is transmitted from the printer driver software to the printer 1. In accordance with the transmitted print data, the central control unit 101 rotates the sheet supply rollers 2, causing the sheets of special coating paper to be supplied from the newly set sheet pack 11 into the printer, and also drives the print head 5 to execute the printing-out of the photographic data (S108).

Thus, since the user can know the quality of sheets 4 of printing paper before starting the printing, the user can surely print the photographic data on the sheets of special coating paper while preventing the data from being printed on the sheets of ordinary paper by mistake.

Although the sheet size is displayed as being A4 in step S106 in the above description, it may occur that data is not to be printed on sheets of A4-size printing paper, but letter size, for example. In such a case, printing run is not instructed in step S107, and the A4-size printing paper sheet pack set at that time is exchanged with another one which contains sheets of printing paper in letter size.

If the sheet pack 11 is not set and no bar code is detected in step S102 (represented by NO of S102), the central control unit 101 determines whether a request for printing-out is received from the host PC 100, and if so (represented by YES of S110), it transmits a signal indicative of "no sheet" via the parallel interface 109 and informs the host PC 100 of the sheets being not set (S111).

In response to such a notice, the host PC 100 displays a message "There is no sheet of printing paper". If the user cancels the request for printing-out upon viewing the message (represented by YES of S112), the control process is ended at once. If the user does not cancel the request for printing-out (represented by NO of S112) and sets the sheet pack 11, the control process returns to step S102 to repeat the subsequent sequence again.

As a result, sheets of printing paper can be very simply supplied to the printer just setting the sheet pack as it is without making the user suffer from inconvenience that has been experienced from the necessity of, e.g., opening a package containing sheets of printing paper, taking out the sheets one by one or in a required number from the package and setting it or them in the printer, or removing sheet cassette from the printer, placing sheets of printing paper in the sheet cassette and setting the sheet cassette onto the printer again.

Also, it is possible to eliminate a fear that finger prints may be put on the sheets, or the sheets may be stained or folded.

Further, by using thick paper, corrugated cardboard, plastics or the like as materials to form the frame 11A and the aid case 10, the sheet pack 11 can be manufactured at a lower cost. Additionally, the present invention can also be implemented without using the aid case 10 with a resultant reduction in cost of the sheet pack.

In this first embodiment, as described above, information such as the quality, size and number of sheets 4 of printing paper contained in the sheet pack 11, which is set onto the printer 1, is displayed before starting the printing, enabling the user to judge, e.g., whether the sheets 4 of printing paper are suitable for the desired printing-out, or whether the desired number of sheets are contained in the sheet pack. If the quality, number, etc. of sheets 4 of printing paper are not suitable, the user can perform the desired printing-out by exchanging the sheet pack 11 with another suitable one.

While the bar code has been used as one example of the information recording member in the above description, the present invention is not limited to that example, but may be implemented by using an IC memory or the like.

Figure 8:
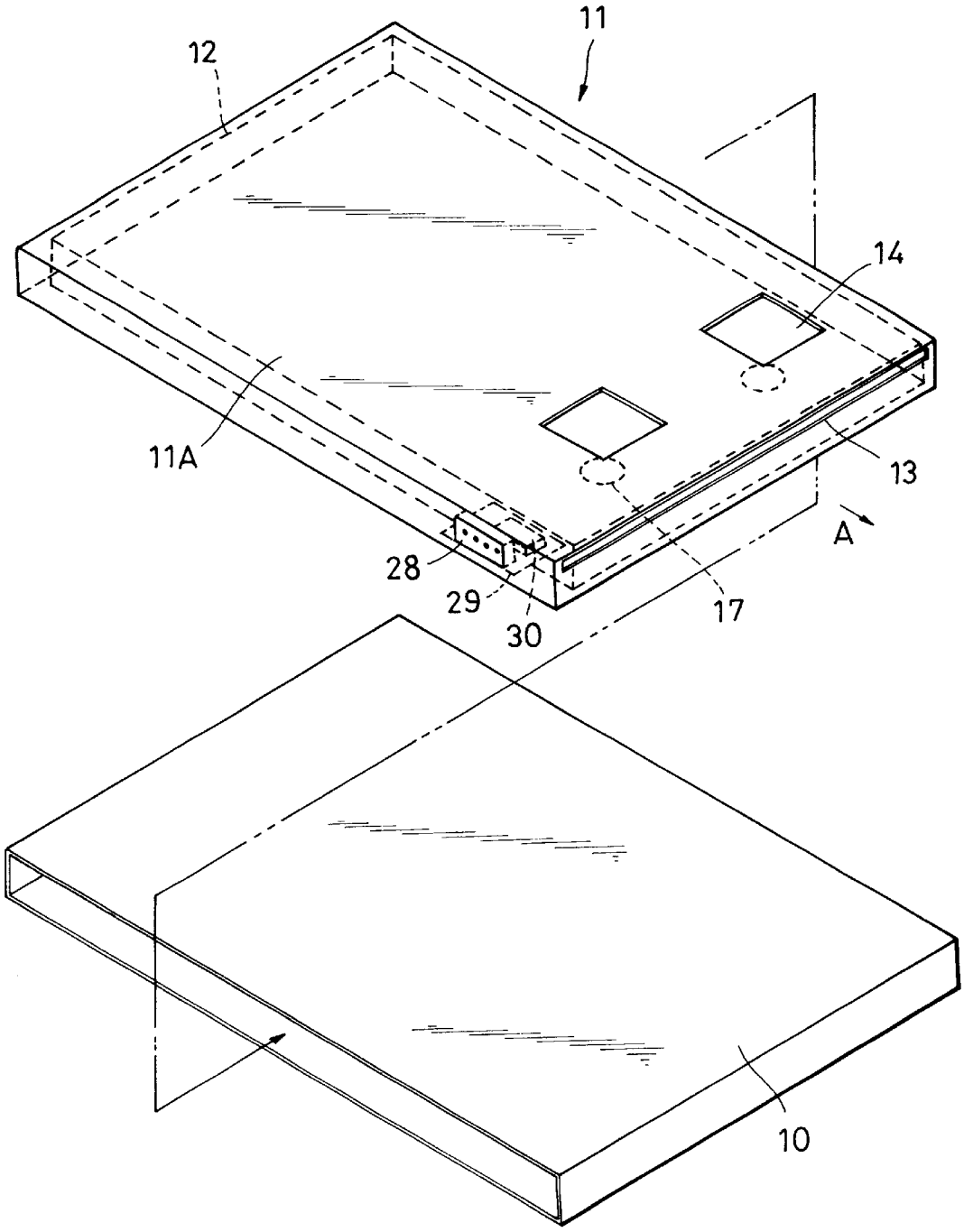
FIG. 8 is a perspective view of a sheet pack according to a second embodiment of the present invention.

FIG. 8 is a perspective view of a sheet pack for use in a printer according to a second embodiment of the present invention, the sheet pack including such an IC memory. Note that, in FIG. 8, the same numerals as those in FIG. 2 denote the same or equivalent components.

Referring to FIG. 8, reference numeral 28 denotes a connector on the sheet pack side, 29 denotes a printed board, and 30 denotes an IC memory fixed to the printed board 29 and recording therein, e.g., the quality, size and number of sheets of printing paper in a bundle 12. The IC memory 30 is of the type enabling information to be read from or written in it while the memory 30 is supplied with electric power, and holding the information while the memory 30 is not supplied with electric power.

Figure 9:
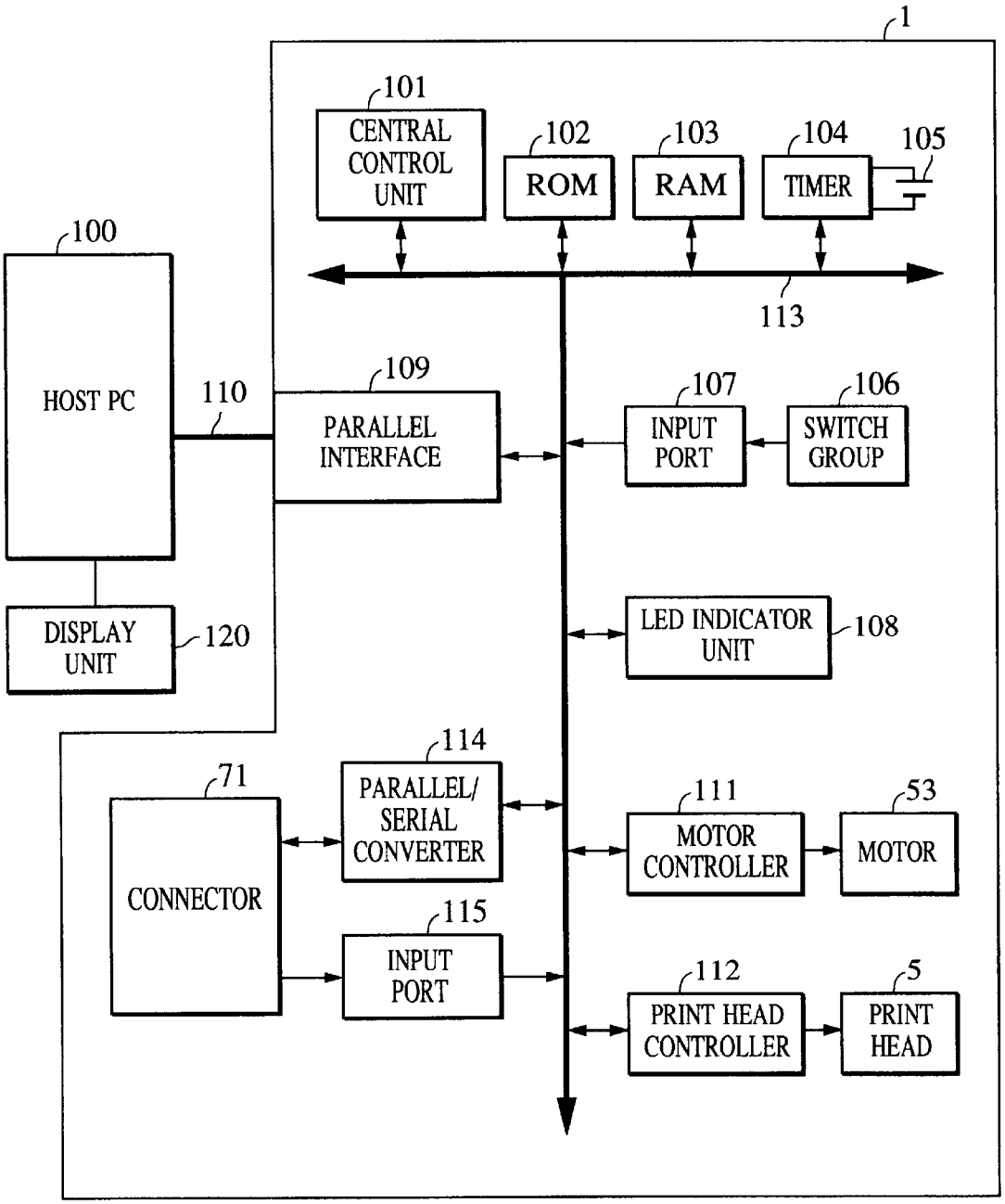
FIG. 9 is a block diagram of a printer and a host PC in the second embodiment.

FIG. 9 is a block diagram of a printer 1 and a host PC 100 in the second embodiment. Note that, in FIG. 9, the same numerals as those in FIG. 6 denote the same or equivalent components.

Referring to FIG. 9, reference numeral 71 denotes a connector on the printer side which is coupled to the connector 28 on the sheet pack side, and 114 denotes a parallel/serial converter. When the sheet pack 11 is set onto the printer 1, the connector 71 on the printer side and the connector 28 on the sheet pack side are coupled to each other. Upon the two connectors 28 and 71 being coupled, electric power is supplied to the IC memory 30 from a power supply unit (not shown) in the printer 1 through the connectors 28 and 71 and the printed board 29.

While the IC memory 30 is supplied with electric power, a central control unit 101 can read information such as the quality, size and number of sheets of printing paper in the bundle 12, that is output as serial data from the IC memory 30, via the printed board 29, the connectors 28 and 71, and the parallel/serial converter 114 after converting the serial data into parallel data.

On the other hand, parallel data output from the central control unit 101 is converted into serial data by the parallel/serial converter 114, and then written in the IC memory 30 via the connectors 28 and 71 and the printed board 29.

Figure 10:
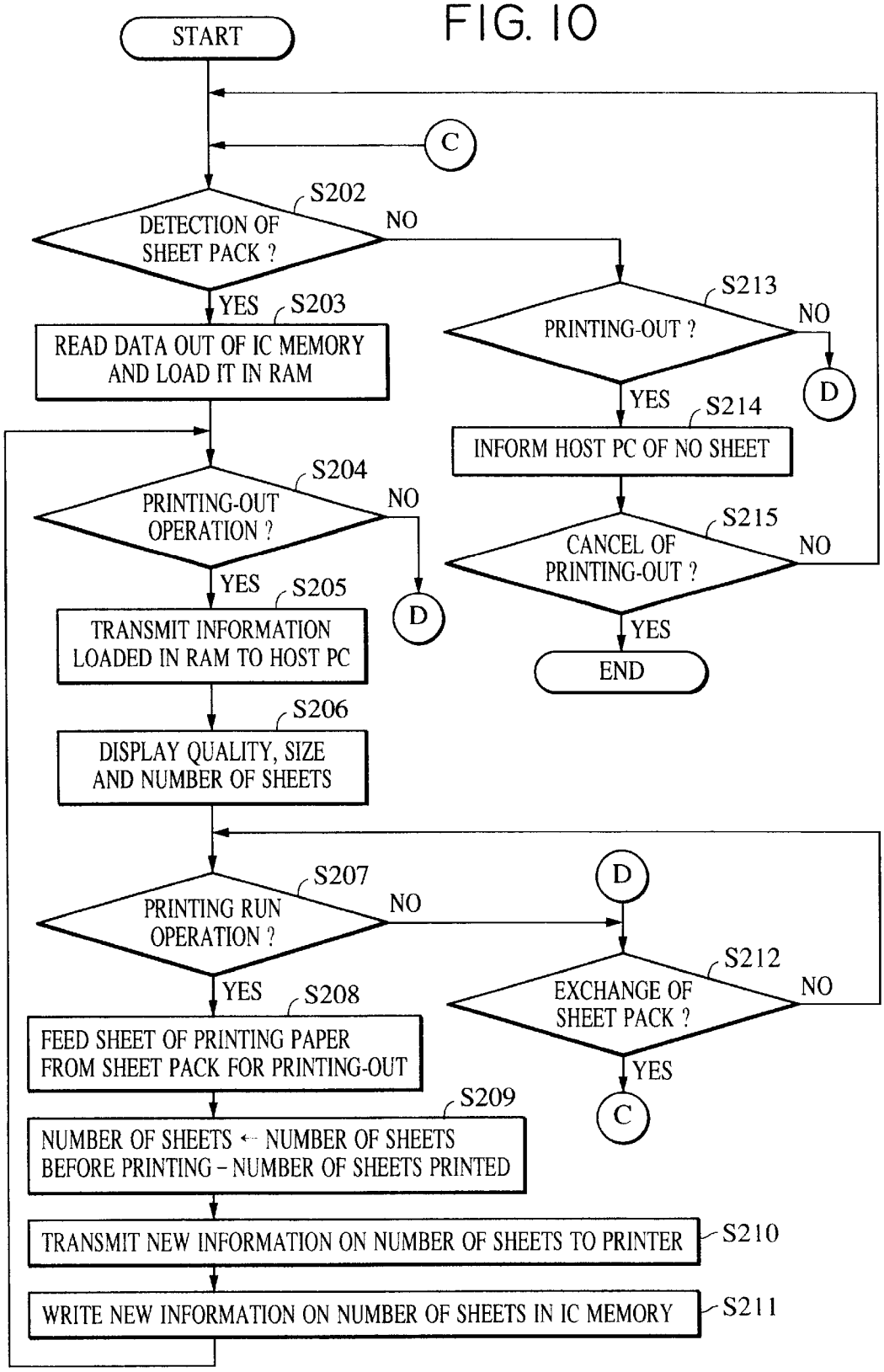
FIG. 10 is a flowchart for explaining the information reading operation and the display operation executed by the printer and the host PC in the second embodiment.

The information reading operation and the display operation executed by the printer and the host PC, which have the above-described construction, will be described below with reference to a flowchart of FIG. 10.

First, when the sheet pack 11 shown in FIG. 8 is set onto the printer 1, as shown in FIG. 1, the connector 28 on the sheet pack side is coupled to the connector 71 on the printer side. At this time, the central control unit 101 detects based on data transmitted via the input port 115 whether the sheet pack 11 including the IC memory 30 is set (S202).

In this embodiment, the input port 115 issues data of, for example, "1" when nothing is coupled to the connector 71 on the printer side, and "0" when the sheet pack 11 is set and the connector 28 on the sheet pack side is coupled to the connector 71 on the printer side. The central control unit 101 can therefore detect that the sheet pack 11 is set when the data obtained from the input port 115 is "0".

If the central control unit 101 detects based on the data from the input port 115 that the sheet pack 11 is set (represented by YES of S202), it loads various information, that is recorded in the IC memory 30, in the RAM 103 via the printed board 29, the connectors 28 and 71 and the parallel/serial converter 114 (S203).

After that, if printing-out key-in operation to instruct printing-out or print setting is executed on the host PC 100 (represented by YES of S204), printer driver software is started up, whereupon the host PC 100 transmits a request for printing-out to the printer 1.

Upon receiving the request signal, the central control unit 101 transmits the data, which is loaded in the RAM 103, to the host PC 100 (S205). Then, the host PC 100 displays the transmitted data such as the quality, size and number of sheets of printing paper in the bundle 12 (S206).

The user then determines, based on the displayed information, that the quality, size and number of sheets of printing paper contained in the sheet pack 11 are the desired ones, and then performs the printing run key-in operation to instruct execution of printing (represented by YES of S207). The print data is then transmitted from the printer driver software to the printer 1.

In accordance with the transmitted print data, the central control unit 101 drives the motor 53 to rotate the sheet supply rollers 2, causing the sheets of printing paper to be supplied from the sheet pack 11 into the printer, and also drives the print head 5 to execute the printing-out (S208).

The host PC 100 sets the number of sheets, which is resulted from subtracting the number of sheets printed out from the number of sheets in the bundle 12 displayed in step S206, to the remaining number of sheets of printing paper in the bundle 12 (S209), and transmits the remaining number of sheets as new information about the number of sheets to the printer 1 (S210). The central control unit 101 then writes the new information about the number of sheets transmitted from the host PC 100 in the IC memory 30 (S211). As a result, the latest number of sheets of printing paper is recorded in the IC memory 30.

If the quality, size or number of sheets of printing paper contained in the sheet pack 11 is judged in step S207 not to be the desired one, then the user may exchange the sheet pack 11 for a desired one. For example, if the sheet pack 11 does not contain sheets of special coating paper, but instead contains sheets of ordinary paper, when photographic data is to be printed out, the user removes the sheet pack 11, which is set at that time, out of the printer 1 for exchange with another sheet pack 11 which contains sheets of special coating paper, but has exactly the same shape as the sheet pack 11 containing sheets of ordinary paper (S212).

If the sheet pack 11 is exchanged with another one (represented by YES of S212), the same sequence as that from step S202 to S206 is repeated to read information from the IC memory 30, transmit the read information, and display such a message on the host PC 100 as indicating that the sheets of special coating paper are set.

Then, if the printing run key-in operation is made in the above state (represented by YES of S207), the print data is transmitted from the printer driver software to the printer 1. In accordance with the transmitted print data, the central control unit 101 rotates the sheet supply rollers 2, causing the sheets of special coating paper to be supplied from the newly set sheet pack 11 into the printer, and also drives the print head 5 to execute the printing-out of the photographic data (S208).

Thus, as with the first embodiment, the user can surely print the photographic data on the sheets of special coating paper while preventing the data from being printed on the sheets of ordinary paper by mistake.

Although the sheet size is displayed as being A4 in step S206 in the above description, it may occur that data is not to be printed on sheets of A4-size printing paper, but letter size, for example. In such a case, printing run is not instructed in step S207, and the A4-size printing paper sheet pack set at that time is exchanged with another one which contains sheets of printing paper in letter size.

If the data obtained from the input port 115 is "1" in step S202, i.e., if the sheet pack 11 is detected as not being set (represented by NO of S202), the central control unit 101 determines whether a request for printing-out is received from the host PC 100, and if so (represented by YES of S213), it transmits a signal indicative of "no sheet" via the parallel interface 109 and informs the host PC 100 of the sheets being not set (S214). In response to such a notice, the host PC 100 displays a message "There is no sheet of printing paper". If the user cancels the request for printing-out upon viewing the message (represented by YES of S215), the control process is ended at once. If the user does not cancel the request for printing-out (represented by NO of S215) and sets the sheet pack 11, the control process returns to step S202 to repeat the subsequent sequence again.

Further, if the number of sheets of printing paper displayed in step S206 is less than the number of sheets to be printed out, or if the number of remaining sheets is zero, the user can take action in one of two ways. One way is to exchange the current sheet pack 11 with another (preferably new) one (represented by YES of S212). The other way is to first execute the printing in number of sheets displayed (represented by YES of S207), then exchange the current sheet pack 11 with another (preferably new) one (represented by YES of S212), and thereafter execute the printing again for the remaining number of sheets.

Incidentally, if the sheet pack 11 containing no sheets of printing paper is exchanged, data indicating that the number of sheets is zero is written in the IC memory 30 of the sheet pack 11 (S211). Therefore, if the user sets such a sheet pack again later for printing by mistake, the user is provided a message indicating that the number of printing paper sheets is zero.

As a result, this second embodiment can provide the following advantages. Similar to the first embodiment, information such as the quality, size and number of sheets of printing paper contained in the sheet pack 11, which is set onto the printer 1, is displayed before starting the printing, enabling the user to judge, e.g., whether the sheets of printing paper are suitable for the desired printing-out, or whether the desired number of sheets are contained in the sheet pack. If the quality, number and so on of sheets 4 of printing paper are not suitable, the user can perform the desired printing-out by exchanging the sheet pack 11 with another suitable one.

Also, since the number of remaining sheets of printing paper is written in the IC memory 30, the user can be provided with that number. Accordingly, the user can judge whether the number of remaining sheets is not less than the number of sheets to be printed out. When the number of remaining sheets is insufficient to print out the entire printing job, the user can execute the printing job by first partially executing the printing job with the remaining sheets and then exchanging the empty sheet pack with another sheet pack, preferably new, or by exchanging the current sheet pack with another sheet pack, preferably new, at once.

While the above second embodiment has been described as mechanically coupling the connector 28 on the sheet pack side and the connector 71 on the printer side to each other, the present invention is not limited to the mechanical coupling, and the two connectors may be coupled electromagnetically or by any other suitable manner. In addition, while the IC memory 30 has been described as being supplied with power from the power supply inside the printer 1, it is also possible to provide a cell within the sheet pack 11 and to read or write data respectively from or in the IC memory 30 by communication via no contacts.

Further, while the host PC 100 has been described in the above second embodiment as subtracting the number of sheets printed out from the number of sheets originally contained in the sheet pack, the probability that the correct number of actually remaining sheets is calculated is increased by executing such subtraction in the central control unit 101 on the printer side, taking into account the fact that two or more sheets may be occasionally fed at a time. In addition, while the above second embodiment has been described as using the number of remaining sheets, by way of example, as the information transmitted from the printer 1 to be recorded in the sheet pack 11, it is also possible to record setting information such as resolution of the printer driver software set when the sheet pack 11 is used. This enables the printer driver software to be easily set to the same condition for printing when the same sheet pack 11 is used again.

While the quality, size and number of sheets 4 of printing paper are recorded as the information obtained from the sheet pack 11 in the above first and second embodiments, the recorded information may also include other data such as the production date of the sheet pack 11 and the thickness and color of sheets of printing paper.

By recording the production date of the sheet pack 11, the user can know whether sheets of printing paper to be used for printing are so old that the sheets are possibly faded, and can surely perform the printing on satisfactory sheets by exchanging the sheet pack 11 with another new one. By recording the thickness of sheets of printing paper, the user can judge whether the thickness of sheets is fit for the printer. By recording the color of sheets of printing paper, the user can change the background color of data to be printed or the color of characters to be printed in match with the sheet color.

Further, in the above first and second embodiments, the printer 1 and the host PC 100 have been described as being connected to each other via the parallel cable. However, the parallel cable may be replaced by a serial interface cable, e.g., a USB (Universal Serial Bus) or IEEE 1394 highperformance serial bus, or by a LAN (Local Area Network) cable. Alternatively, the printer 1 and the host PC 100 may transfer data therebetween by wireless communication such as infrared communication.

The above first and second embodiments have been described as using respectively a bar code to store information and an IC memory to store and change information. As an alternative, it is possible to record and read information with magnetic recording, or to record, read and change information with a hole pattern. These modifications are also involved in the scope of the present invention.

While the above first and second embodiments have been described as displaying the quality, size and number of sheets of printing paper on the display unit 120 of the host PC 100, such information may be displayed on a display unit provided on the printer 1. With this modification, data from a digital camera or the like can be printed by connecting the digital camera or the like to the printer 1.

Figure 11:
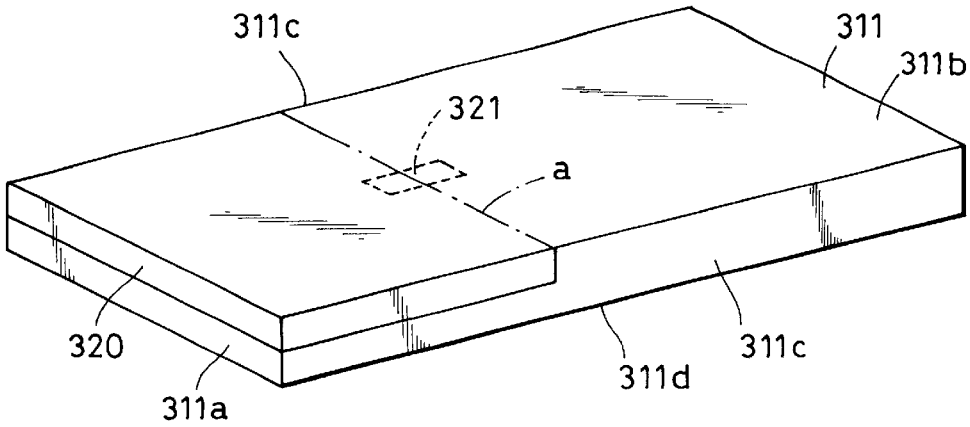
FIG. 11 is an appearance view of a sheet pack according to a third embodiment of the present invention when not in use.
Figure 12:
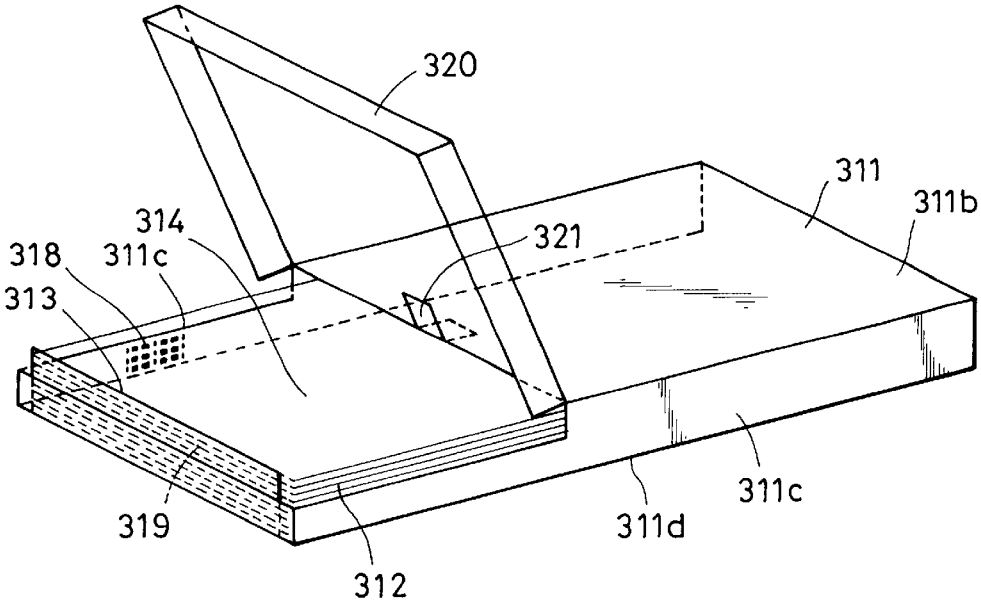
FIG. 12 is an appearance view of the sheet pack shown-in FIG. 11 when in use.

FIGS. 11 and 12 show a sheet pack according to a third embodiment of the present invention, the sheet pack being constructed to be able to open and close partially, either manually by a user or automatically by a printer.

As shown in FIGS. 11 and 12, a sheet pack 311 is in the form of a rectangular box during transportation and in use, and contains a predetermined number of sheets of printing paper therein.

An outer casing of the sheet pack 311 can be opened and closed partially, either manually by a user or automatically by a printer. More specifically, in this third embodiment, the sheet pack 311 has an opening/closing portion 320 constructed to be able to open and close, and comprising an upper half of a fore wall 311*a* at the end through which sheets of printing paper are fed one by one, a part of an upper wall 311*b*, and parts of both side walls 311*c*. The opening/closing portion 320 of the sheet pack 311 is rotatable about a dotted line indicated by reference letter "a". The opening/closing portion 320 may be manually opened and closed by the user lifting portion 320 up from the remainder of the sheet pack 311 so that it rotates about the dotted line "a". In this case, inclusion of a spring 321 on the spring pack, as shown in FIGS. 11 and 12, is not necessary. However, even if spring 321 is included on the sheet pack 311, portion 320 may nonetheless be manually opened by the user (automatic opening and closing of portion 320 via spring 321 is discussed further below). The manually-opened sheet pack may then be placed into a printer 301. When the sheet pack is removed from the printer 301, portion 320 may be manually closed. When the opening/closing portion 320 is rotated upward as shown in FIG. 12, it is allowed to swing about 180° so that the sheet pack 311 is opened at the upper half of the fore end wall 311*a*, the part of the upper wall 311*b*, and the parts of both the side walls 311*c* thereof, thus making the sheets of printing paper in a bundle 312 exposed to the outside. Upon the opening/closing portion 320 being made open, a sheet supply opening 313 is opened forward and an abutment opening 314 is opened widely upward.

Further, reference numeral 318 denotes a bar code provided as one example of an information recording member on one side wall 311*c* of the outer casing of the sheet pack 311. Information such as the quality, size and number of sheets of printing paper contained in the sheet pack 311 is recorded in the form of the bar code 318. For example, the bar code 318 on the sheet pack 311 containing 100 sheets of specific coated printing paper in A4 size records therein beforehand such information that paper quality is of the specific coated type, that the sheet size is A4, and that the number of sheets is 100.

Reference numeral 319 denotes a separating pad provided on a surface of a pressure plate 316, described later, facing the sheets of printing paper in the bundle 312 to serve as a sheet separating mechanism capable of separating the sheets individually with the aid of friction.

Automatic opening and closing of the opening/closing portion 320 of sheet pack 311 will now be described. When the sheet pack 311 is set onto a printer 301 (see FIG. 14), the opening/closing portion 320 first strikes against predetermined engagement portion of the printer and is then opened upon the sheet pack 311 being further pushed into the printer. Reference numeral 321 denotes a spring which is in the form of a flat plate when the opening/closing portion 320 is closed, and which is bent when the opening/closing portion 320 is opened. When the spring 321 is bent, it gains a force to restore it to the form of a flat plate.

Figure 13:
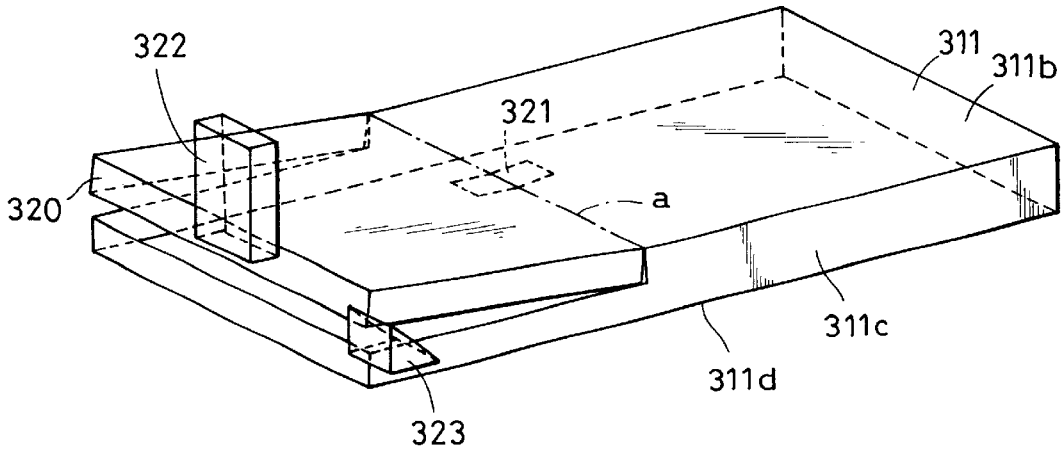
FIG. 13 is a perspective view showing a mechanism for opening an opening/closing portion of the sheet pack shown in FIG. 11.

FIG. 13 shows a mechanism attached to the printer body for rotating the opening/-closing portion 320 of the sheet pack 311 open. The rotating mechanism comprises a first engagement portion 322 and a second engagement portion 323 disposed along an inclined attachment stand 303 (see FIG. 14) to which the sheet pack 311 is set. The first engagement portion 322 is arranged above the attachment stand 303 in such a position that when the sheet pack 11 is obliquely inserted downward along the attachment stand 303, the first engagement portion 322 engages a front wall of the opening/closing portion 320 to rotate it upward by a small amount. The second engagement portion 323 has an inclined cam surface and is arranged at one side of the attachment stand 303 in such a position that when the opening/closing portion 320 is rotated upward by that small amount, the second engagement portion 323 enters a gap between a lower edge of one side wall of the opening/closing portion 320 and an upper front edge of one side wall 311*c* of the sheet pack 311, as shown in FIG. 13. As the sheet pack 311 is further inserted, the opening/closing portion 320 is rotated upward by a large amount by the second engagement portion 323.

Figure 14:
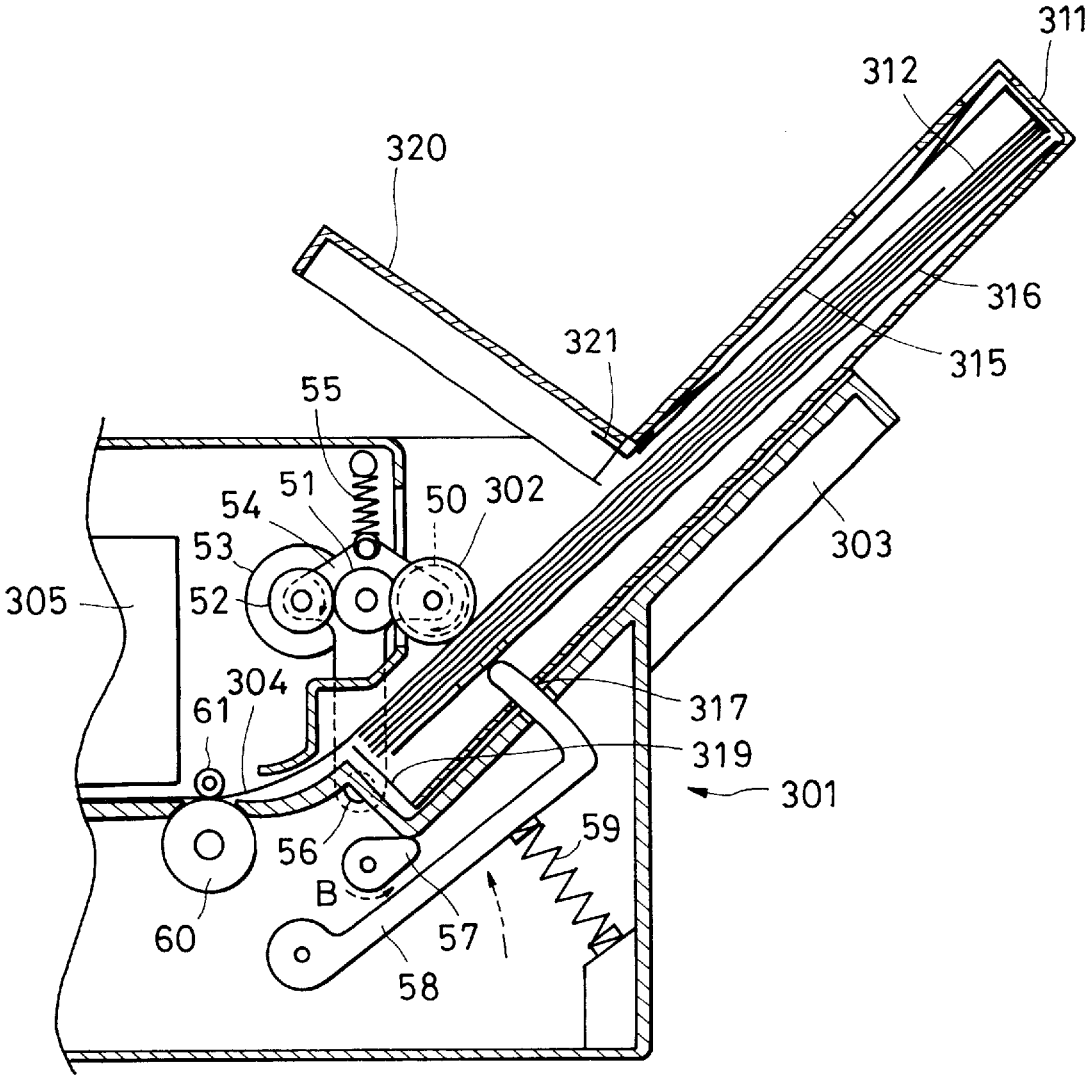
FIG. 14 is a partial sectional view showing a printer onto which the sheet pack shown in FIG. 11 is set.

When the sheet pack 311 is fully inserted to a predetermined position in the attachment stand 303, it takes a condition shown in FIG. 14 where the opening/-closing portion 320 is opened and the sheets of printing paper in the sheet pack are ready to be supplied.

The first engagement portion 322 is provided on the printer body in a rotatable manner such that after engaging the opening/closing portion 320 and rotating it upward a small amount, the first engagement portion 322 is in turn rotated by the opening/closing portion 320. This rotation displaces the first engagement portion 322 into a position out of interference with further rotation of the opening/closing portion 320.

Additionally, when the sheet pack 311 is taken out of the attachment stand 303, the opening/closing portion 320 is returned to the original closed position by the restoring action of the spring 321.

FIG. 14 is a sectional view showing a condition where the sheet pack 311 is set onto the printer 301.

In FIG. 14, reference numeral 315 denotes a leaf spring provided inside the sheet pack 311 to serve as means for urging the sheets of printing paper in the bundle 312 to retract from sheet supply rollers 302 when the sheets are not supplied to the printer 301, 316 denotes a pressure plate for bringing the bundle 312 of sheets into pressure contact with the sheet supply rollers 302 when the sheets are supplied to the printer 301, 317 denotes a pressure contact opening formed in the bottom wall 311*d* of the outer casing of the sheet pack 311. The pressing lever 58 on the side of the printer 1 is allowed to enter the sheet pack 311 through the pressure contact opening 317 for bringing the top one of the sheets 12 of printing paper into abutment with the sheet supply rollers 302.

As with the above-described embodiment, the leaf spring 315 is disposed on the same side of the bundle 312 of sheets as the upper wall 311*b* of the sheet pack 311, and the pressure plate 316 is disposed on the opposite side of the bundle 312 of sheets, i.e., on the same side as the bottom wall 311*d* of the sheet pack 311.

Reference numeral 302 denotes a sheet feed roller and 305 is a print head. Reference numeral 304 denotes a sheet of printing paper supplied from the sheet pack 311 into the printer 301. Other components denoted by the same reference numerals as those in FIGS. 4 and 5 are the same as those shown in FIGS. 4 and 5, and therefore are not described here.

By using thick paper, corrugated cardboard, plastics or the like as materials to form the outer casing of the sheet pack 311, the sheet pack can be manufactured at a lower cost and can be easily discarded by users after the sheets of printing paper contained in the sheet pack are all used up. Moreover, it is also possible to recover the sheet pack 11 for reuse.

According to this third embodiment, when the sheet pack 311 is set onto the printer 301, the sheet supply opening and the abutment opening are automatically formed, and when the sheet pack 311 is removed from the printer 301, those opening are automatically closed. Thus, since there is no need of providing the sheet supply opening and the abutment opening in the sheet pack beforehand, the sheet pack 311 can be held in a completely enclosed state. As a result, the sheets 302 of printing paper in the sheet pack 311 can be protected against dust, extraneous light, temperature, humidity, finger prints, etc. without using the aid case 10 of the first embodiment.

Figure 15:
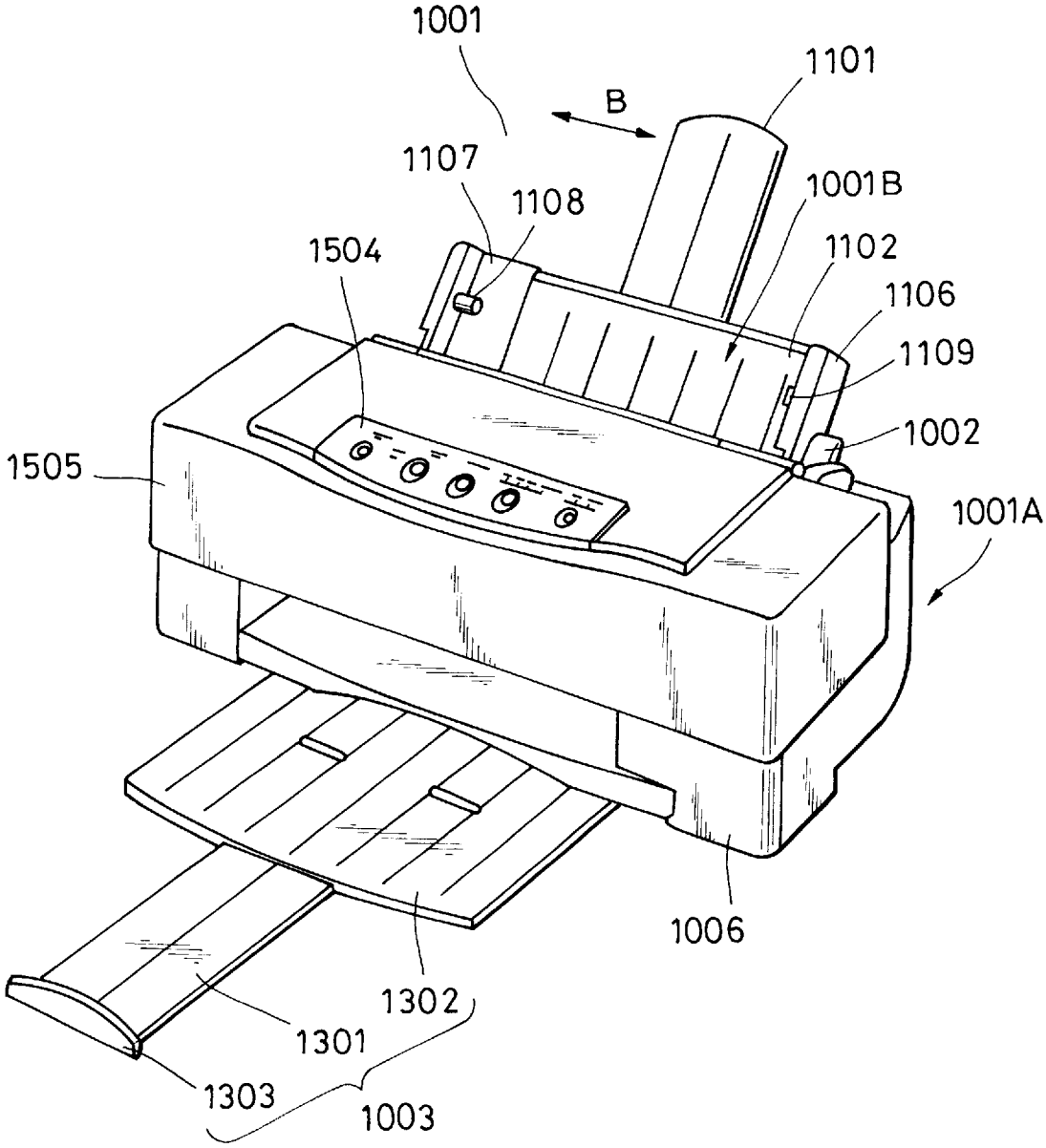
FIG. 15 is a perspective view of an ink jet recording apparatus, as one example of an image forming apparatus, provided with a sheet feeder according to a fourth embodiment of the present invention.
Figure 16:
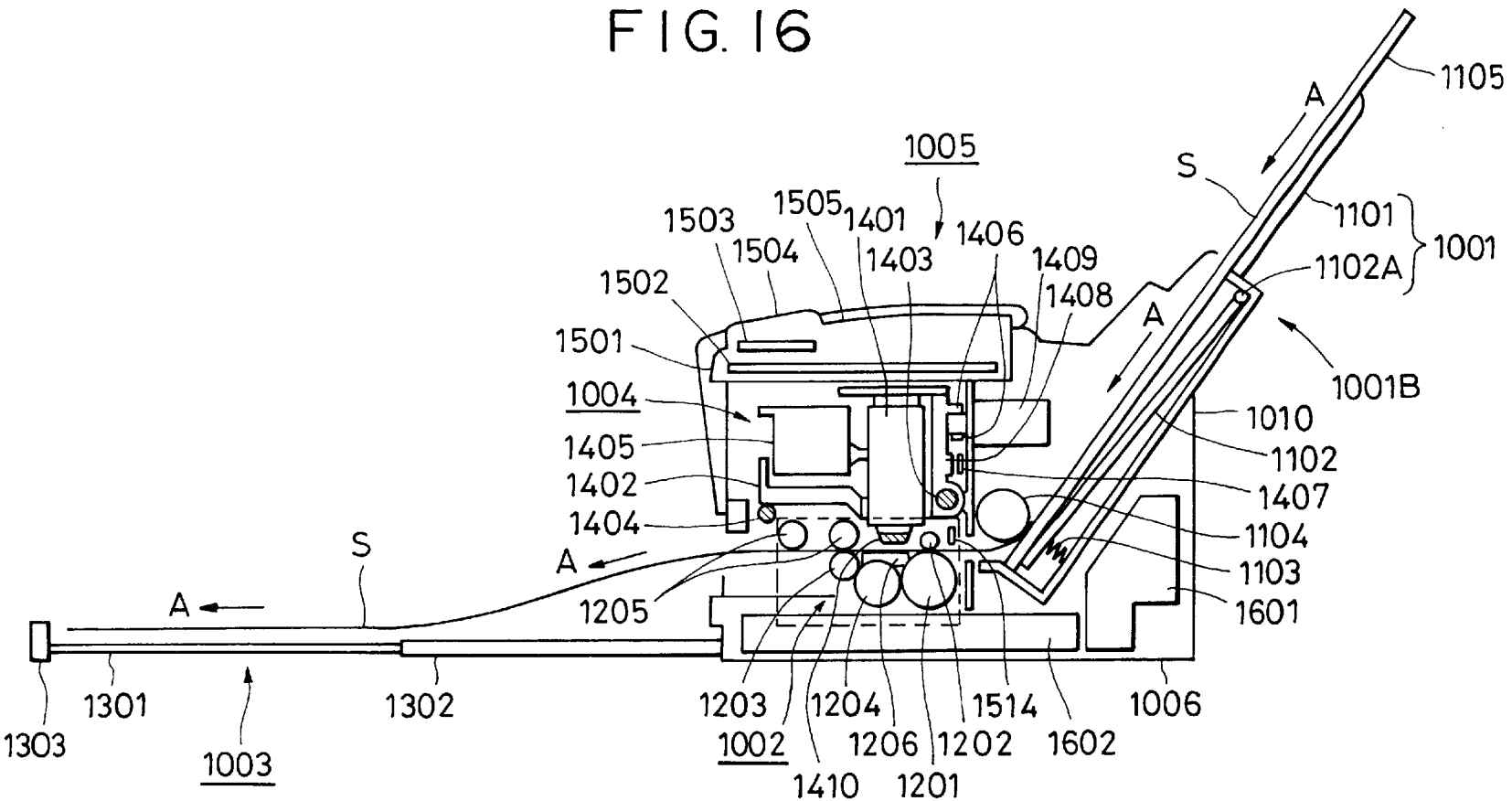
FIG. 16 is a sectional view of the recording apparatus shown in FIG. 15.

FIG. 15 is a perspective view of an ink jet recording apparatus, as one example of an image forming apparatus, provided with a sheet feeder according to a fourth embodiment of the present invention, and FIG. 16 is a sectional view of the recording apparatus shown in FIG. 15.

In FIGS. 15 and 16, reference numeral 1001 denotes an automatic supply section which is constituted by a sheet feeder for automatically supplying a sheet-like recording medium S (referred to as a sheet hereinafter), such as a sheet of printing paper or film, into a body 1001A of the recording apparatus, 1002 denotes a feeding section for introducing the sheets S supplied one by one from the automatic supply section 1001 by a supply roller 1104 to a predetermined recording position as indicated by arrows A and then introducing the sheet S, on which recording has been made, to a discharge section 1003, and 1004 denotes a recording section where data is recorded by a recording head 1401 on the sheet S fed to the recording position through the feeding section 1002.

Also, reference numeral 1005 denotes a control section positioned above the recording section 1004 and constituted by a control unit for controlling the recording operation of the apparatus body 1001A in accordance with recording information sent from a host computer (not shown) or the like and results detected by various sensors provided inside the apparatus body 1001A.

The automatic supply section 1001 comprises a sheet receiver 1101 made of two receiving plates combined with each other in an extensible manner, a pressure plate 1102 which has one end supported to a rotatable shaft 1102A and the other end brought into pressure contact with the supply roller 1104 by resilient force of a pressing spring 1103, and so on. The supply roller 1104 is rotated in cooperation with a feed roller 1201 of the feeding section 1002 which is driven through a train of gears and driving change-over means, not shown, thereby sending the sheets S one by one from a bundle 1105 of the sheets set on the sheet receiver 1101.

Further, a pair of guide members 1106, 1107 are provided in the automatic supply section 1001 and are spaced from each other in the direction of width of the sheet S for guiding widthwise opposite side ends of the sheet S. One 1107 of the pair of guide members 1106, 1107 is provided to be movable by a sliding mechanism (not shown) in the direction of width of the sheet S as indicated by arrow B in FIG. 15. The other guide member 1106 serves to determine the recording position of the sheet S with respect to the recording section 1004, and to prevent the sheet S from being supplied on a skew in cooperation with the guide member 1107.

The sheet receiver 1101, the pressure plate 1102 and the guide members 1106, 1107 jointly constitute a sheet containing portion 1001B in the automatic supply section 1001. A bundle of sheets are set in the sheet containing portion 1001B at the time of starting the printing. A sheet container (sheet pack), described later, is removably set to the sheet containing portion 1001B.

Moreover, the pair of guide members 1106, 1107 are provided with respective bosses 1108, 1109 projecting inward in the direction of width of the sheet S. When the later-described sheet pack is set to the sheet containing portion 1001B, the bosses 1108, 1109 fit into fitting grooves formed in the sheet pack to hold it in place. The bosses 1108, 1109 are provided in the sheet containing portion 1001B to position above its bottom surface, on which sheets are stacked, by a predetermined distance, e.g., 10 mm in this fourth embodiment, in the direction of height of a sheet stack. When the sheet pack is not employed, a bundle of sheets are set between the bosses 1108, 1109 and the bottom surface of the sheet containing portion 1001B.

The feeding section 1002 serving as feeding means includes a feed roller 1201 rotated through a not-shown train of gears by a later-described feed motor 1207, shown in FIG. 17, for introducing the sheet S supplied from the automatic supply section 1001 to a position opposite to an ink ejection nozzle 1410 which is provided as recording means in a recording head 1401 of the recording section 1004, a pinch roller 1202, a transmission gear 1204 rotated in conjunction with the feed roller 1201 for transmitting driving force to a discharge roller 1203, guide rollers 1205 each supported by a coil spring (not shown), and a platen portion 1206. The platen portion 1206 serves to introduce the fore end of the sheet S, which has been fed by the feed roller 1201 and the pinch roller 1202 to there, to the discharge roller 1203 and the guide rollers 1205.

The discharge section 1003 comprises a tray 1302 attached to the apparatus body 1001A, and a slide tray 1301 being able to extend and contract depending on the length of the sheet S discharged. A stop 1303 is provided at the fore end of the slide tray 1301 to prevent the discharged sheet S from dropping down.

The recording section 1004 comprises a carriage 1402 on which the recording head 1401 provided with the nozzle 1410 are mounted, two guide shafts 1403 and 1404 for guiding the carriage 1402 by a timing belt 1406 in a direction vertical to the direction of feeding of the sheet S (i.e., in a direction vertical to the drawing sheet of FIG. 16), and an ink tank 1405 which serves as recording material supply means for supplying ink in respective colors to the recording head 1401. Note that, in this embodiment, the nozzle 1410 ejects ink in four colors, i.e., yellow, magenta, cyan and black, to be adaptable for color recording.

The recording section 1004 further comprises an encoder 1407 having a plurality of slits formed in a film with predetermined intervals (not shown), an encoder sensor 1408 provided on the carriage 1402 for detecting the slits of the encoder 1407, these encoder 1407 and encoder sensor 1408 cooperating to detect the position of the carriage 1402, and a DC motor 1409 serving as a carriage motor to move the carriage 1402 during a scan.

Additionally, the position of the carriage 1402 is detected at all times by the cooperation of the slits of the encoder 1407 and the encoder sensor 1408 as the carriage 1402 is scanned, on the basis of the position of a detected member 1411*b* (shown in FIG. 23) detected by a home sensor 1411*a* which is disposed on the path of scan of the carriage 1402 and is constructed of a transmission-type photosensor or the like provided on the carriage 1402.

The control section 1005 comprises a casing 1505, a control board 1502, a panel board 1503 and a control panel 1504. Reference numeral 1501 denotes an inner cover for covering the control board 1502 and the panel board 1503. The control panel 1504 is exposed to an upper surface of the inner cover 1501.

Moreover, in FIG. 16, reference numeral 1006 denotes a lower case of the apparatus body 1001A, 1601 denotes a power supply unit fixedly contained in the lower case 1006, and 1602 denotes an discharged ink tank for containing ink ejected for the operation of restoring ink ejection and sucked from the recording head 1401 through an ejection restoring processing portion (not shown). Reference numeral 1010 denotes a side case forming a side wall of the apparatus body 1001A.

Figure 17:
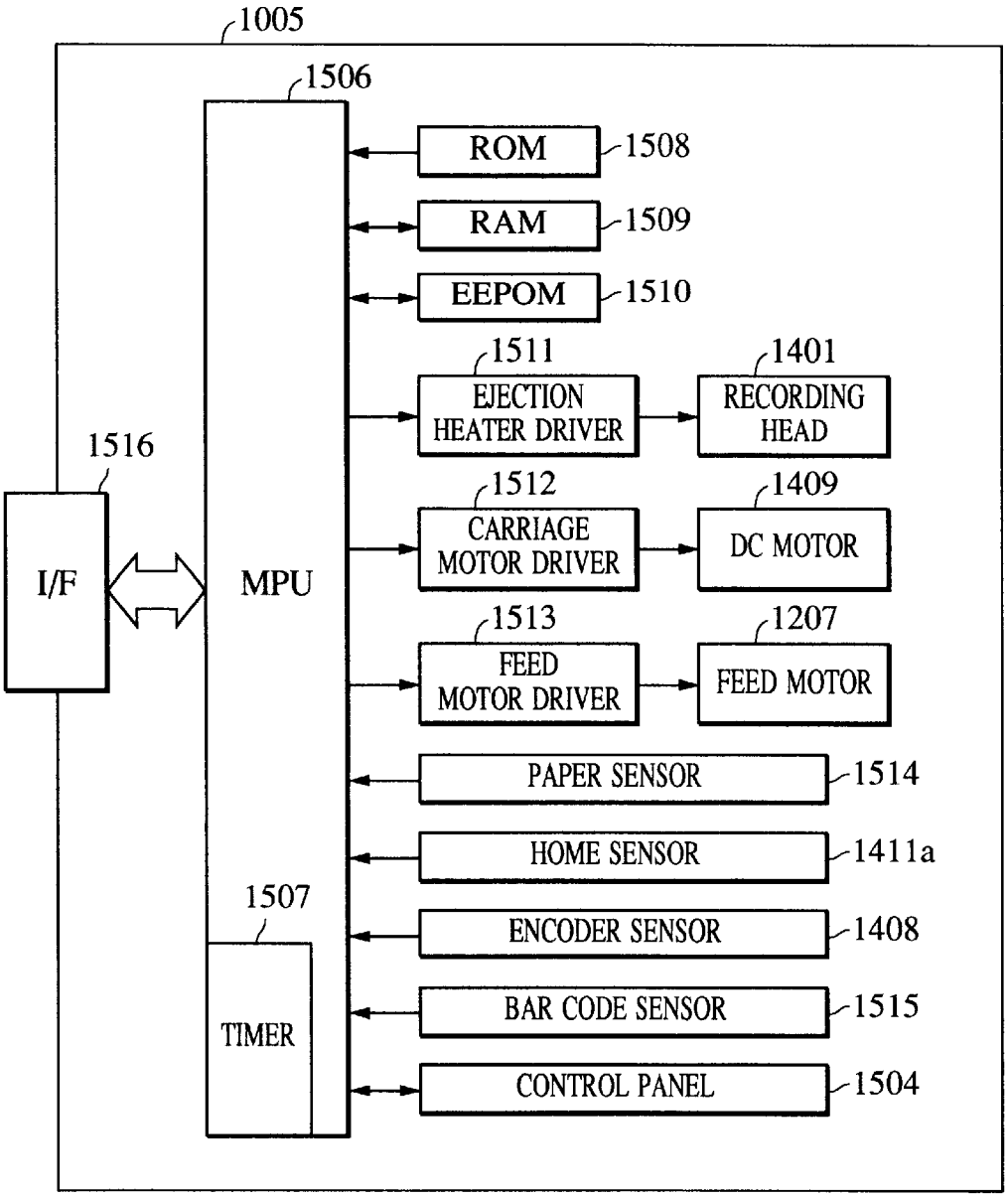
FIG. 17 is a block diagram showing the functional configuration of a control section in the ink jet recording apparatus shown in FIG. 15.

FIG. 17 is a block diagram showing the functional configuration of the control section 1005 in this fourth embodiment. In FIG. 17, reference numeral 1506 denotes an MPU for controlling the entirety of the recording apparatus, the MPU 1506 including a timer 1507 for time management in the control process. Reference numeral 1508 denotes a ROM for storing control programs, etc. used by the MPU 1506, and 1509 denotes a RAM serving as a work area for use in execution of control by the MPU 1506 and storing information such as a speed of the carriage 1402 detected by the cooperation of the encoder 1407 and the encoder sensor 1408. Reference numeral 1510 denotes an EEPROM capable of holding information therein even after the power supplied to the recording apparatus is turned off.

Reference numeral 1511 denotes an ejection heater driver for energizing an ejection heater (not shown) so that ink is ejected from the nozzle 1410 of the recording head 1401 in accordance with recording information, etc. sent from a host computer or the like, and 1512 denotes a carriage motor driver for energizing the DC motor 1409 to drive the carriage 1402 through the timing belt 1406, pulleys (not shown), etc. Reference numeral 1513 denotes a feed motor driver for controllably driving the feed motor 1207 to rotate the feed roller 1201 and the supply roller 1104.

Reference numeral 1514 denotes a paper sensor which is disposed in plural number downstream of the supply roller 1104 in this embodiment for detecting whether the sheet S is present in the feeding section 1002, and detecting the leading and tailing edges of the sheet S. Reference numeral 1516 denotes an interface (I/F) for connecting the apparatus body 1001A and electronic equipment such as a host computer. The control section 1005 can exchange information to and from the host computer or the like via the interface 1516.

Further, reference numeral 1515 denotes a bar code sensor which serves as means for detecting a bar code put on a later-described sheet pack and identifying information recorded in the bar code, e.g., the type of sheets contained in the sheet pack. The MPU 1506 can determine in accordance with an identification signal from the bar code sensor 1515 whether the sheet pack is set to the sheet containing portion 1001B.

Figure 18:
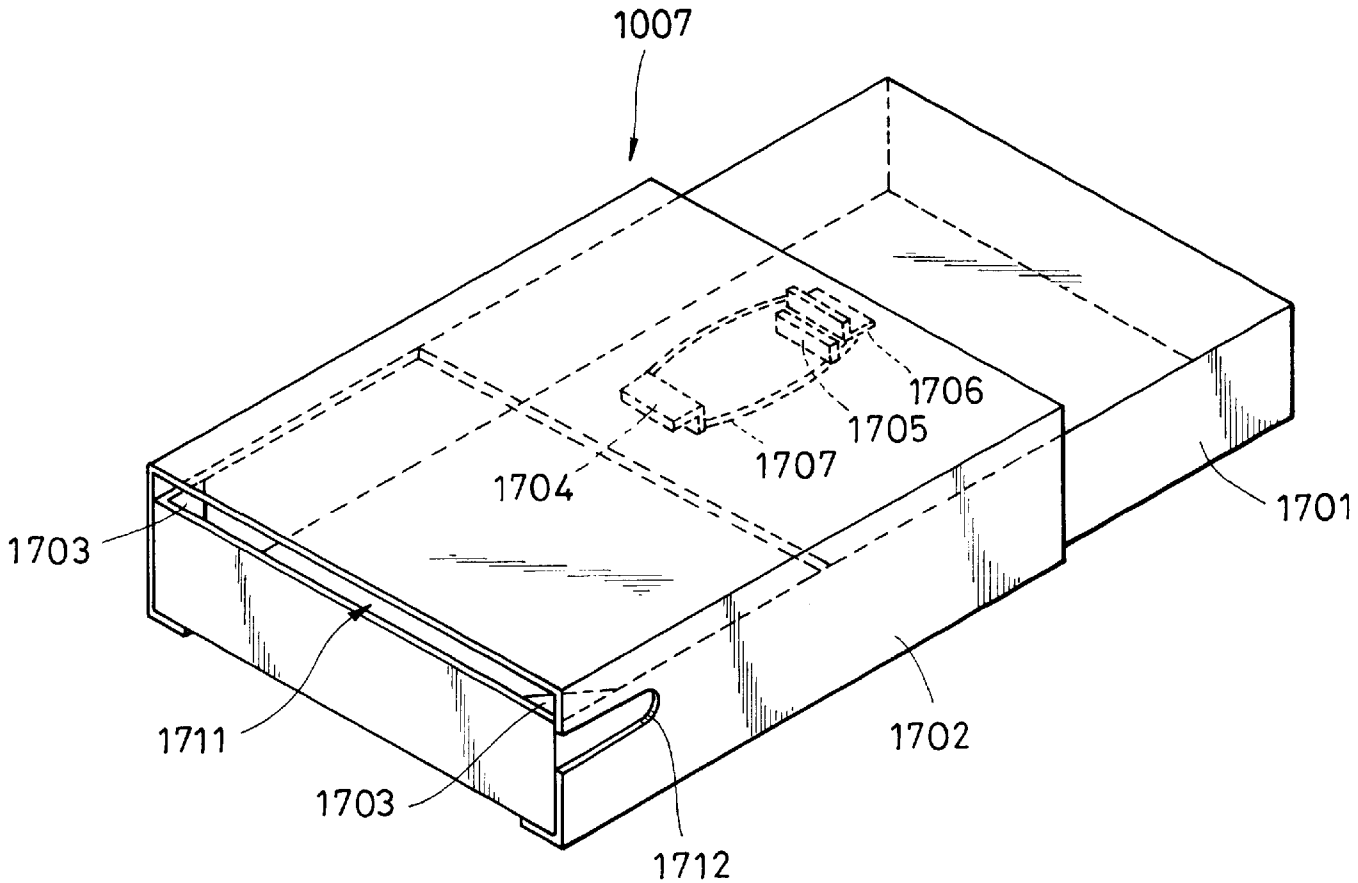
FIG. 18 is a schematic appearance view of a sheet pack removably set onto the recording apparatus shown in FIG. 15.

FIG. 18 is a schematic appearance view of a sheet container or pack 1007 containing a bundle of sheets and removably set to the sheet containing portion 1001B described above, and FIG. 19 is a sectional view of the sheet pack shown in FIG. 18.

Figure 19:
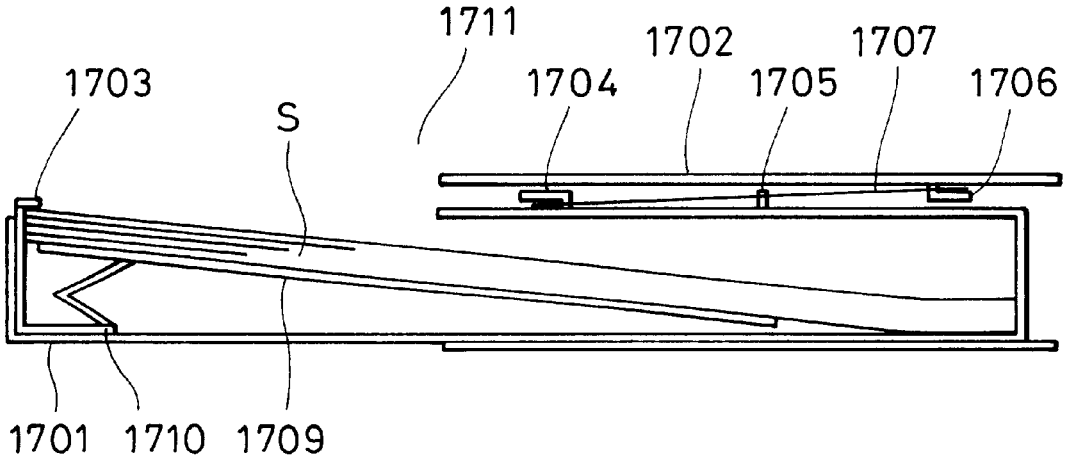
FIG. 19 is a sectional view of the sheet pack shown in FIG. 18.

In FIGS. 18 and 19, reference numeral 1701 denotes a sheet case serving as means for containing a bundle of sheets which are placed in the sheet case through an opening 1711 formed in an upper wall of the sheet case in its end portion locating on the head side when sheet pack 1007 is inserted. The sheet case 1701 includes a pressure plate 1709 for pressing the sheets contained in the case to come into pressure contact with the supply roller 1104 of the automatic supply portion 1001, a spring member 1710, and a separating member 1703 in the form of a pawl, for example, for separating the top sheet S from a bundle of remaining sheets. In this embodiment, the pressure plate 1709, the spring member 1710 and the separating member 1703 are formed of a thin metal sheet as an integral unit which is fixed to the sheet case 1701 by means of, e.g., bonding.

Reference numeral 1702 denotes a cover member serving as cover means which is slidably fitted over the sheet case 1701. The cover member 1702 is normally located in a position to cover the opening 1711, and when the sheet pack 1007 is set to the sheet containing portion 1001B, the cover member 1702 is slid to a position where the opening 1711 is uncovered, thus making the sheets contained in the sheet case 1701 exposed to the outside.

The sheet case 1701 and the cover member 1702 are resiliently connected to each other through a resilient member 1707 such that when the sheet pack 1007 is set to the sheet containing portion 1001B, the cover member 1702 is slid against the resiliency of the resilient member 1707 to the position where the opening 1711 is uncovered.

Additionally, reference numerals 1704 and 1706 denote latches provided respectively on the sheet case 1701 and the cover member 1702 for latching opposite ends of the resilient member 1707. Also, reference numeral 1705 denotes a positioning member provided on the sheet case 1701 in such a position as causing the cover member 1702 to cover the opening 1711 when the latch 1706 is held against the positioning member 1705.

In both side walls of the cover member 1702, there are formed fitting grooves 1712 serving as coupling means which are fitted to the bosses 1108, 1109 provided on the guide members 1106, 1107 of the automatic supply section 1001 for coupling the sheet pack 1007 to the sheet containing portion 1001B when the sheet pack 1007 is set to the sheet containing portion 1001B. Stated otherwise, the sheet pack 1007 is inserted into the sheet containing portion 1001B while the bosses 1108, 1109 are fitted to the respective fitting grooves 1712.

Figure 20:
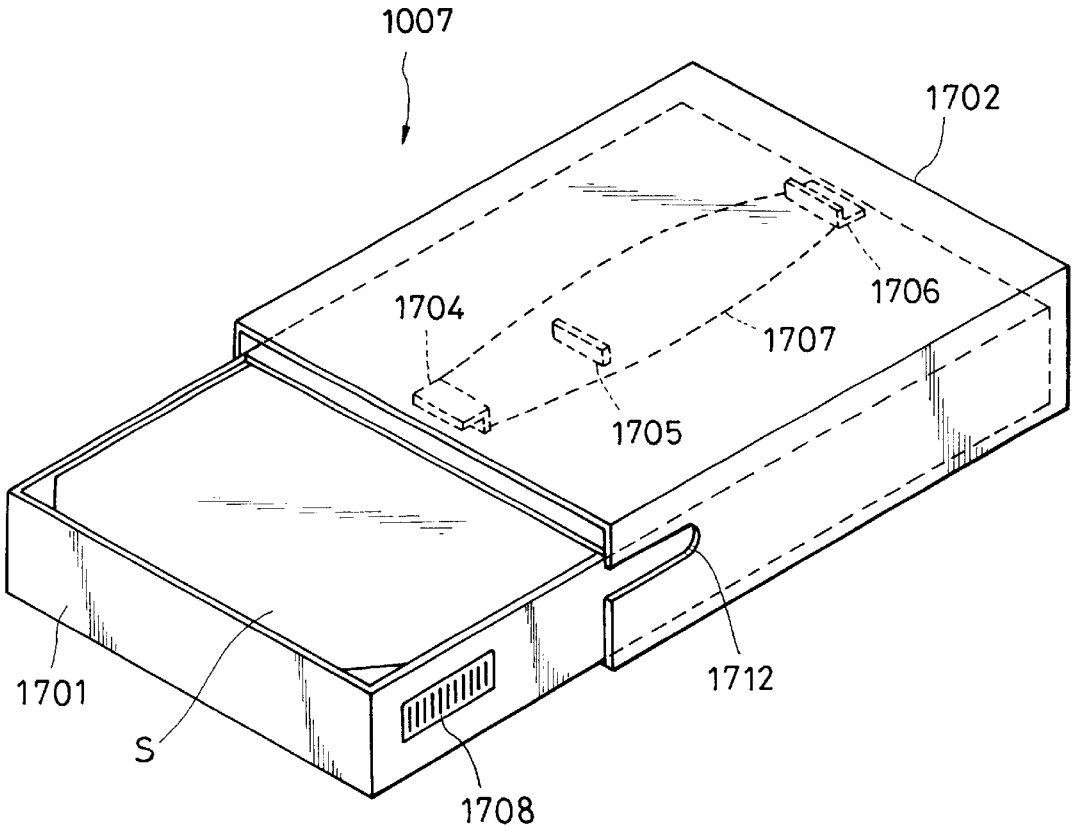
FIG. 20 is a perspective view of the sheet pack, showing a state where a cover member is slid in a direction to make the sheet pack open.
Figure 21:
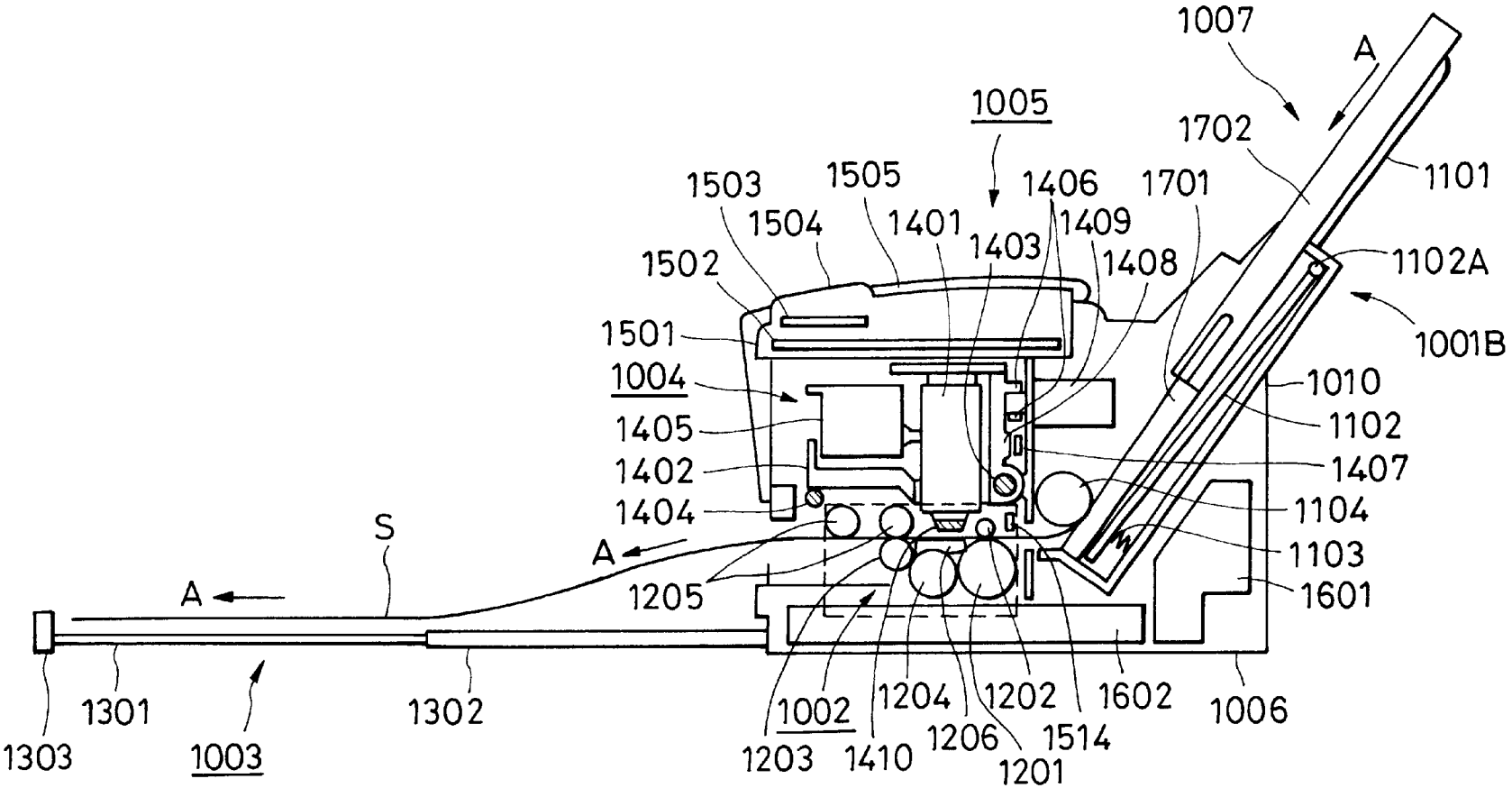
FIG. 21 is a sectional view of the recording apparatus in a state where the sheet pack shown in FIG. 18 is set onto the recording apparatus.

Then, when the sheet pack 1007 is inserted into the sheet containing portion 1001B in that way, the cover member 1702 is slid by being pressed by the bosses 1108, 1109 against the resiliency of the resilient member 1707 in the direction to uncover the opening 1711. FIG. 20 shows a state where the cover member 1702 is slid to make the sheet pack open, and FIG. 21 shows a state where the sheet pack 1007 is set to the sheet containing portion 1001B.

In FIG. 20, reference numeral 1708 denotes a bar code, as one example of information holding means, which is put on one side wall of the sheet case 1701 and holding information such as the type of sheets contained in the sheet case. The bar code 1708 is exposed to the outside upon sliding of the cover member 1702. On the other hand, the bar code sensor 1515 (see FIG. 17) is provided in the apparatus body 1001A in a position adapted to read the bar code 1708 and detect the information such as the type of sheets contained in the sheet case when the bar code 1708 is exposed to the outside upon sliding of the cover member 1702.

When the sheet pack 1007 is removed from the sheet containing portion 1001B, the cover member 1702 is slid by the resilient force of the resilient member 1707 to the position where the latch 1706 for the resilient member 1707 is held against the positioning member 1705, so that the opening 1711 and the bar code 1708 are covered by the cover member 1702.

The sheet pack 1007 having the above-described construction is normally in a condition where the opening 1711 is covered by the cover member 1702, and functions as a storage box for the sheets S. Furthermore, where a predetermined number of sheets are contained in the sheet pack and the whole of the sheet pack is packaged into the form of a bag by using a packing member (not shown), the sheet pack can also function as a package box transported from the manufacturer to the user.

Figure 22:
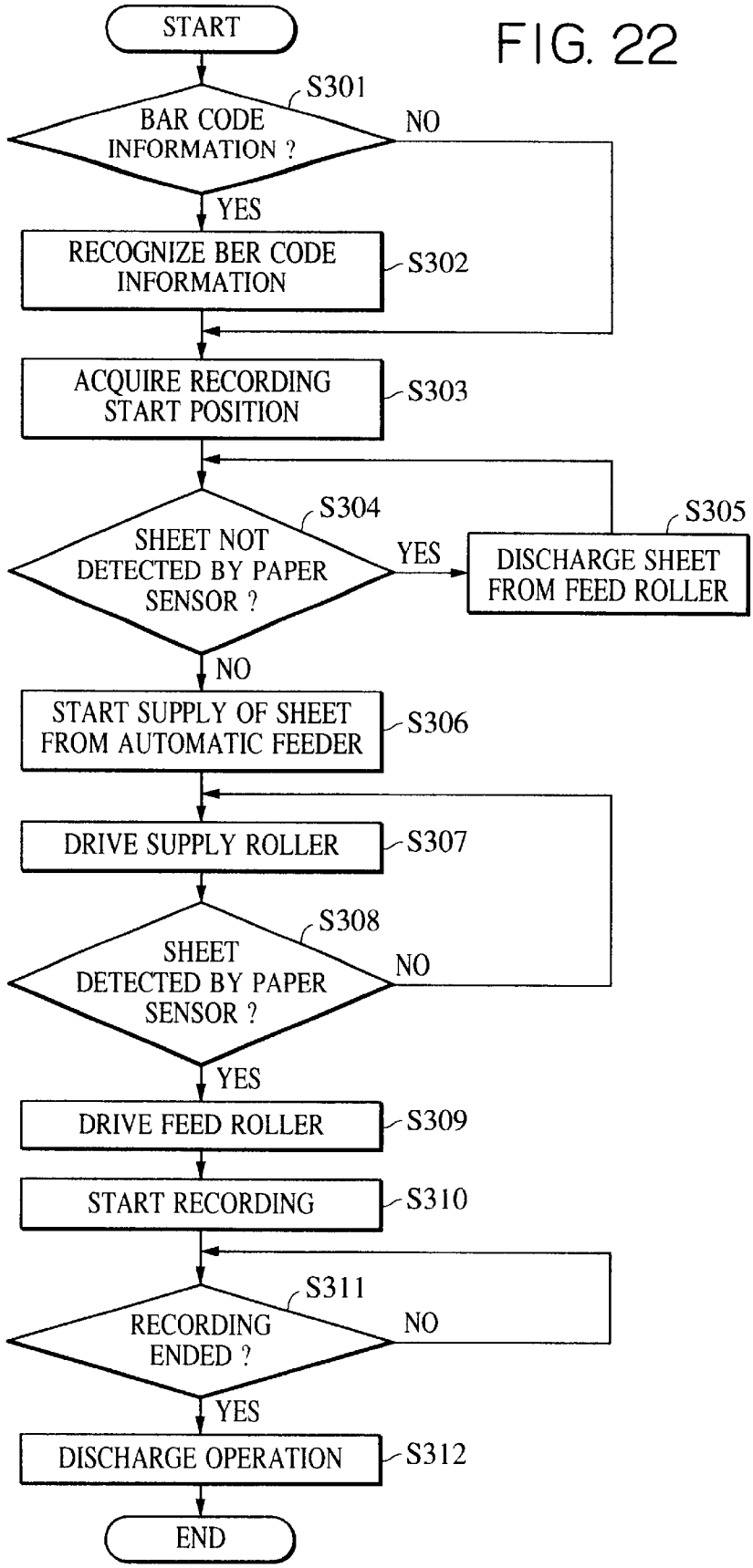
FIG. 22 is a flowchart for explaining the sheet supply operation of the recording apparatus including the sheet pack, shown in FIG. 18, set onto it.

The operation of supplying sheets in the recording apparatus, onto which a sheet pack 1007 having the above-described construction may have been set, will now be described with reference to a flowchart shown in FIG. 22.

When a command instructing the start of recording is transmitted from the electronic equipment (not shown), such as a host computer, to the control section 1005 via the I/F 1516, the MPU 1506 checks whether bar code information is detected by the bar code sensor 1515 (S301). If no bar code information is detected by the bar code sensor 1515 (represented by NO of S301), the MPU determines that the sheet pack 1007 has not been set in the sheet containing portion 1001B, and then starts the operation of recording by feeding sheets (outside a sheet pack) set in the sheet containing portion 1001B as conventionally done.

On the other hand, when the sheet pack 1007 is set in the sheet containing portion 1001B, the cover member 1702 is slid to uncover the opening 1711 and the bar code 1708 is exposed to the outside, as shown in FIG. 21. In this case, therefore, the bar code sensor 1515 reads the bar code 1708, and the bar code information is input to the MPU 1506. If the bar code information is thus detected by the bar code sensor 1515 (represented by YES of S301), the MPU determines that the sheet pack 1007 is set, and then recognizes the bar code information held in the bar code 1708, for example, that the sheets contained in the sheet pack 1007 are coated paper (S302).

Figure 23:
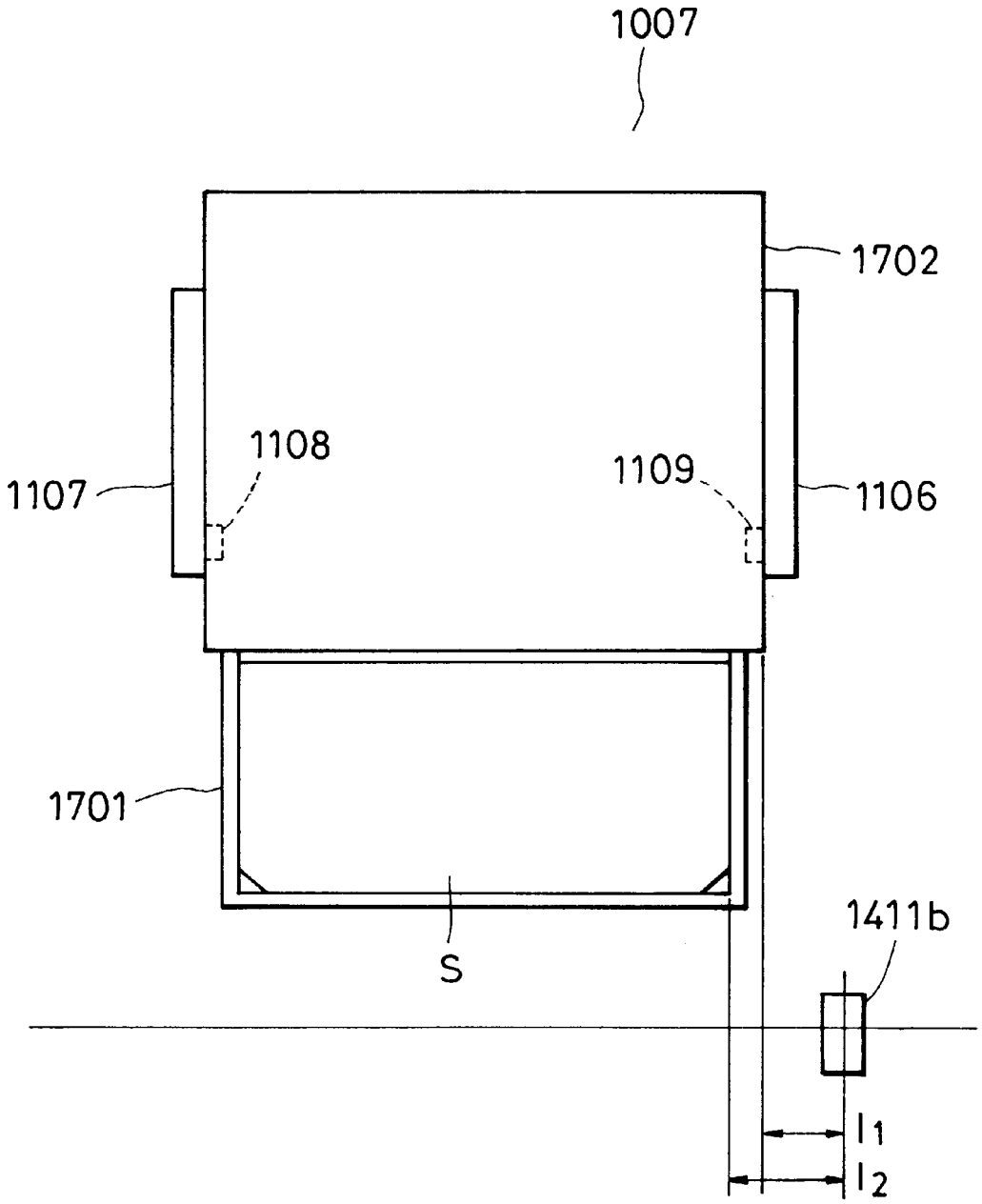
FIG. 23 is a plan view of the recording apparatus in a state where the sheet pack shown in FIG. 18 is set to a sheet receiving portion of the recording apparatus.

Then, the MPU 1506 acquires a reference position for the start of recording in the direction of width of the sheet (S303). When the sheet pack 1007 is set, the side end of the sheet S is positioned inward of a home position 1411*b* in the direction of width of the sheet by a distance $l_2$, as shown in FIG. 23. Therefore, the position inward of the home position 1411*b* by the distance $l_2$ is selected as the reference position for the start of recording. When the sheet pack 1007 is not set, the guide member 1106 fixedly provided in the automatic supply section 1001 gives the reference position for the start of recording. In this case, the side end of the sheet S is positioned inward of the home position 1411*b* in the direction of width of the sheet by a distance $l_1$.

Subsequently, the MPU 1506 confirms whether the sheet is not detected by the paper sensor 1514 inside the apparatus body 1001A (S304). If the sheet is detected (represented by YES of S304), the feed roller 1201 is rotated to discharge the sheet out of the apparatus body 1001A (S305). If the sheet is not present in the apparatus body 1001A (represented by NO of S304), the supply roller 1104 in the automatic supply section 1001 is rotated to start supply of the sheet (S306), whereby the sheet S is supplied from the sheet pack 1007 to reach the paper sensor 1514 (S307 and S308).

After the leading end of the sheet is detected by the paper sensor 1514, the sheet is advanced a predetermined distance. The feed roller 1201 is then rotated (S309) to start the recording (S310). The MPU 1506 continues the recording in accordance with the reference position for the start of recording, described above, and the information of the bar code 1708 until the end of recording is commanded (S311). When the recording is ended, the sheet S is discharged out of the apparatus body 1001A by the feed roller 1201 (S312), thus completing a sequence of recording operation steps.

As described above, since the recording apparatus has such a construction that the sheet pack 1007 is set to the sheet containing portion 1001B, the size of the recording apparatus can be reduced. Also, since the recording apparatus has such a construction that individual sheets can also be set and supplied without using the sheet pack 1007, versatility of the recording apparatus for various sizes of sheets is not lost. Further, since information about the sheets contained in the sheet pack 1007 is obtained, the operation of setting, etc. required prior to the start of recording can be simply made based on the obtained information. By providing a separating member in the sheet pack 1007 suitable for the sheets contained therein, it is possible to improve a capability of supplying the sheets.

In addition, since the sheet pack 1007 is set to the sheet containing portion 1001B, the user can be free from inconvenience of setting individual sheets, and can operate the recording apparatus with higher efficiency. Also, since the sheets S are kept in an enclosed state with the cover member 1702 covering the sheet case 1701, it is possible to preserve the sheets in a better condition. Further, by containing a predetermined number of sheets in the sheet pack 1007 beforehand and then packaging the whole of the sheet pack into a package box transported in that form, the sheets can be more efficiently handled.

While the sheet pack 1007 includes the sliding cover member 1702 in the above description, the present invention is not limited to such a construction, and the cover member 1702 may be preferably constructed such that it rotates about a certain shaft to selectively cover the sheets. Also, while the separating member 1703 is constructed to separate sheets individually with a pawl, it is not limited to the illustrated one, but may be constructed in various forms, e.g., a member having a predetermined slit, depending on the nature of sheets contained in the sheet pack. Further, the pressure plate, the spring member, etc. may be preferably modified to have any of other various suitable construction than illustrated. While a bar code is used in the above-described embodiment as one example of information holding means put on the sheet pack 1007, the information holding means may be otherwise implemented by utilizing magnetism or an IC.

When the sheets contained in the sheet pack 1007 are all used up in the above-described embodiment, the sheet pack 1007 may be employed again by putting sheets therein. In such a case, it is conceivable to separately prepare information holding members such as bar codes, for example, corresponding to the types of sheets, and put on the relevant bar code on the sheet pack by sticking or the like.

A fifth embodiment of the present invention will be described below.

Figure 24:
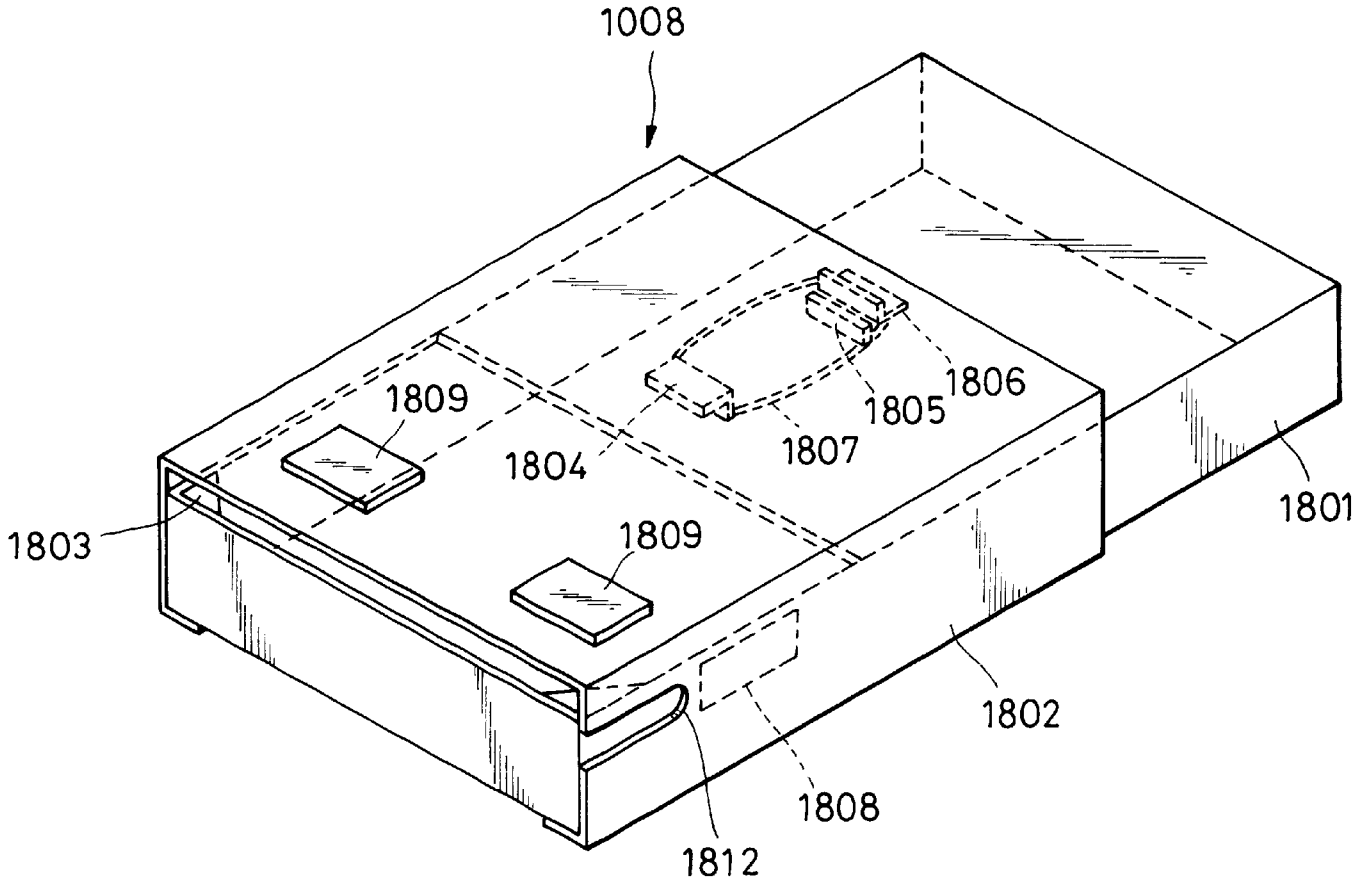
FIG. 24 is a schematic appearance view of a sheet pack removably set to a sheet feeder according to a fifth embodiment of the present invention.

FIG. 24 is a perspective view of a sheet pack removably set to a sheet feeder according to the fifth embodiment of the present invention. In FIG. 24, reference numeral 1008 denotes a sheet pack which has cleaning members 1809 as means for cleaning respective supply rollers 1104 to further improve a capability of supplying the sheets S in recording apparatus.

The cleaning members 1809 are provided on an outer surface of a cover member 1802 of the sheet pack 1008 in positions to face the supply rollers 1104 of the automatic supply section 1001 when the sheet pack 1008 is set to the sheet containing portion 1001B. In this embodiment, the cleaning members 1809 are each made of rubber, porous resin, or other materials having adhesion. The supply rollers 1104 are rotated while keeping pressure contact with the cleaning members 1809, to thereby remove dust, paper dust, etc. stuck to surfaces of the supply rollers 1104.

In this embodiment, a bar code 1808 holds information about the type and number of sheets contained in the sheet pack. Additionally, reference numerals 1804 and 1806 denote latches, and reference numeral 1805 denotes a positioning member hatches 1804 and 1806 and positioning member 1805 operate in the same way as latches 1704 and 1706 and positioning member 1705 shown in FIGS. 18–20.

Figure 25:
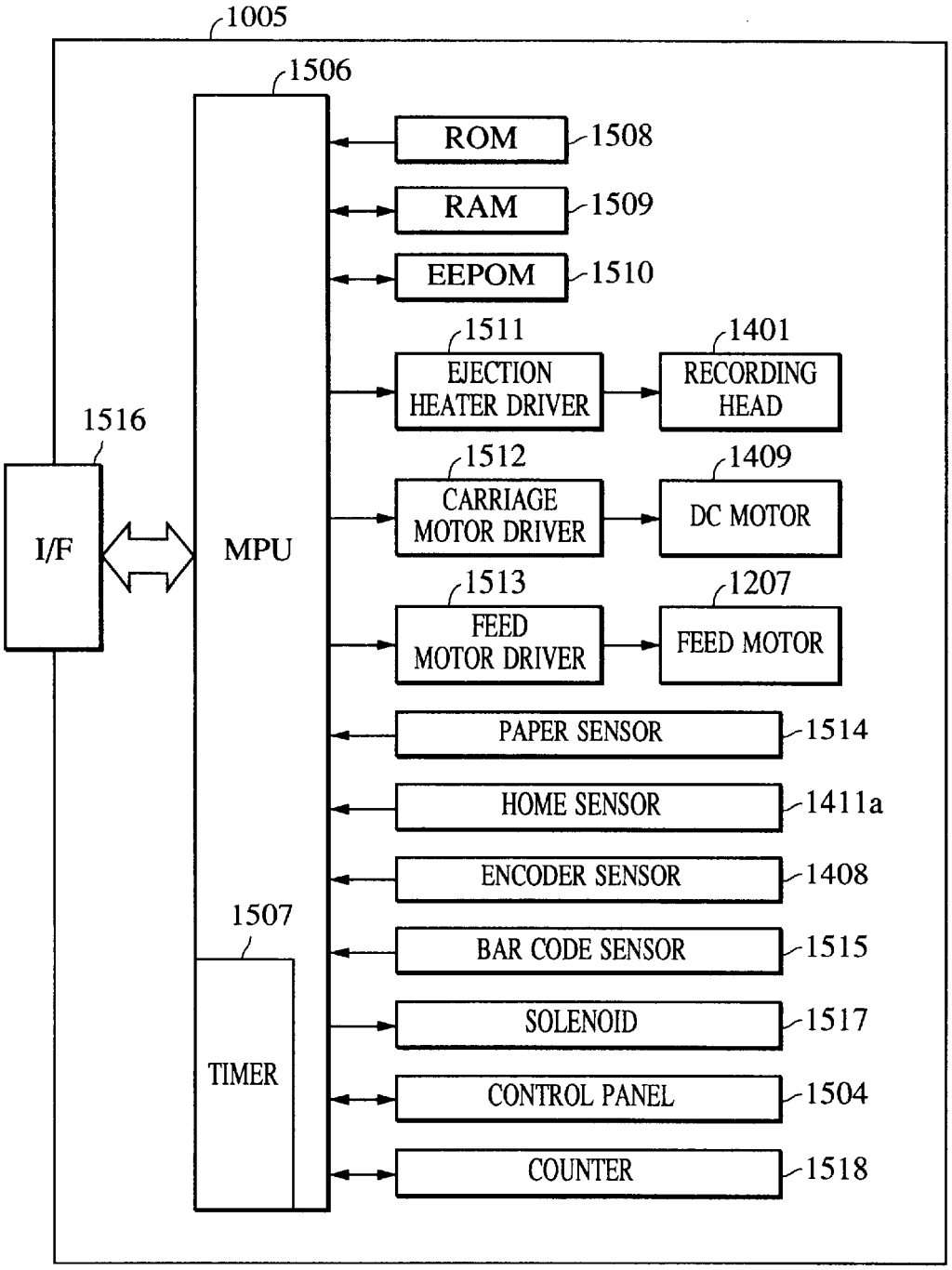
FIG. 25 is a block diagram showing the functional configuration of a control section in a recording apparatus in the fifth embodiment.
Figure 26:
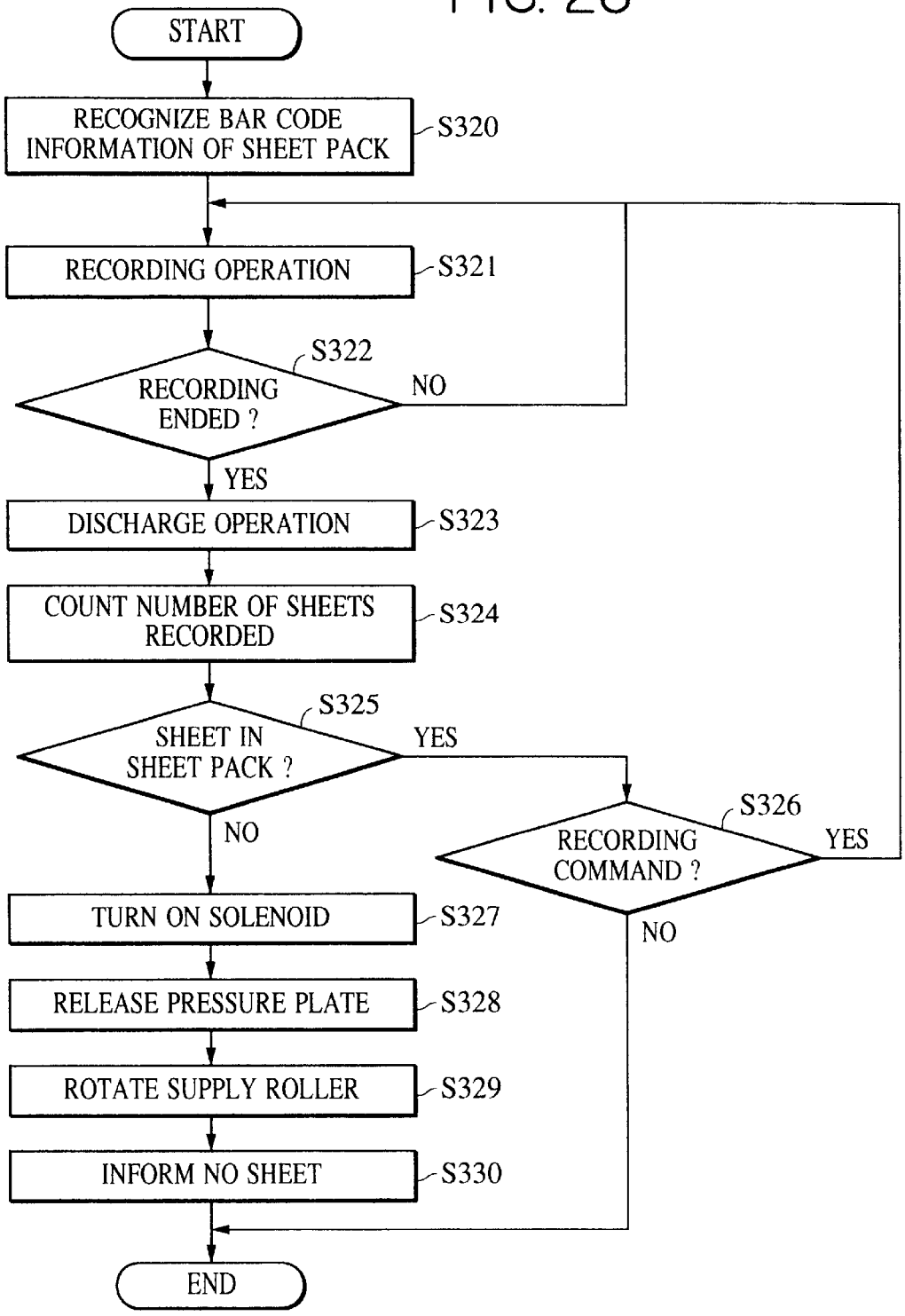
FIG. 26 is a flowchart for explaining the sheet supply operation of the recording apparatus including the sheet pack, shown in FIG. 24, set onto it.

FIG. 25 is a block diagram showing the functional configuration of a control section 1005 in a recording apparatus onto which the sheet pack 1008 is suitably set. In FIG. 26, reference numeral 1517 denotes a solenoid which is connected through a spring (not shown) or the like to bosses 1108, 1109 (see FIG. 15) which are provided in the automatic feed section 1001 to serve as means for coupling the sheet pack 1008 with the sheet containing portion 1001B.

The solenoid 1517 is energized for actuation in accordance with an instruction from the MPU 1506. When the solenoid 1517 is energized for actuation, the bosses 1108, 1109 are retracted to positions where they are not fitted to fitting grooves 1812 of the sheet pack 1008. When the solenoid 1517 is not energized, the bosses 1108, 1109 are projected to positions where they are fitted to the fitting grooves 1812 of the sheet pack 1008 as with the fourth embodiment.

Further, reference numeral 1518 denotes a counter which serves as means for counting the number of recorded sheets based on detection of the leading and tailing ends of each sheet by the paper sensors 1514. A result counted by the counter 1518 is stored in the EEPROM 1510 as a non-volatile memory.

The operation of cleaning the supply rollers 1104 in accordance with this embodiment thus constructed will be described with reference to a flowchart shown in FIG. 26.

In a flow of operation steps shown in FIG. 26, the operation from step of setting the sheet pack 1008 in the recording apparatus to step of discharging the sheet supplied from the sheet pack 1008 out of the recording apparatus, i.e., step S320 of recognizing bar code information of the set sheet pack 1008, namely, step of recognizing information about the type and number of sheets, step S321 of operation for executing the recording, step S322 of determining the end of recording, and step S323 of operation for discharging the sheet, is carried out similarly to the operation described above with reference to FIG. 22.

After the operation of discharging the sheet, the MPU 1506 counts the number of recorded sheets (S324), and loads a counted result in the EEPROM 1508 of the control section 1005. The number of recorded sheets is counted by incrementing the above-mentioned counted value loaded in the EEPROM 1508 one by one each time the sheet is discharged, i.e., by counting the number of sheets supplied from the sheet pack 1008.

Then, the MPU 1506 determines whether there is a sheet in the sheet pack 1008 (S325) based on both the counted result of the number of recorded sheets loaded in the EEPROM 1508 and the bar code information. If it is determined that sheets remain in the sheet pack 1008 (represented by YES of S325), the MPU then checks whether a recording command is issued from the host computer or the like (S326). If the recording command is issued (represented by YES of S326), the recording operation is continued. If the recording command is not issued (represented by NO of S326), the sequence of operation steps is ended at once.

On the other hand, if it is determined that there are no more sheets in the sheet pack 1008 (represented by NO of S325), the MPU 1506 energizes (turns on) the solenoid 1517 to retract the bosses 1108, 1109 for releasing them from the fitting grooves 1812 of the sheet pack 1008 (S327).

At the same time, the MPU 1506 energizes not only the solenoid 1517, but also the feed motor 1207 by a predetermined amount, thereby releasing the pressure plate 1102 of the automatic supply section 1001 to move away from the supply rollers 1104 (S328). With this operation, the cover member 1802 is slid under the action of the resilient member 1807 to cover the opening of the sheet case 1801, and the cleaning members 1809 provided on the cover member 1802 are positioned to face the supply rollers 1104.

Figure 27:
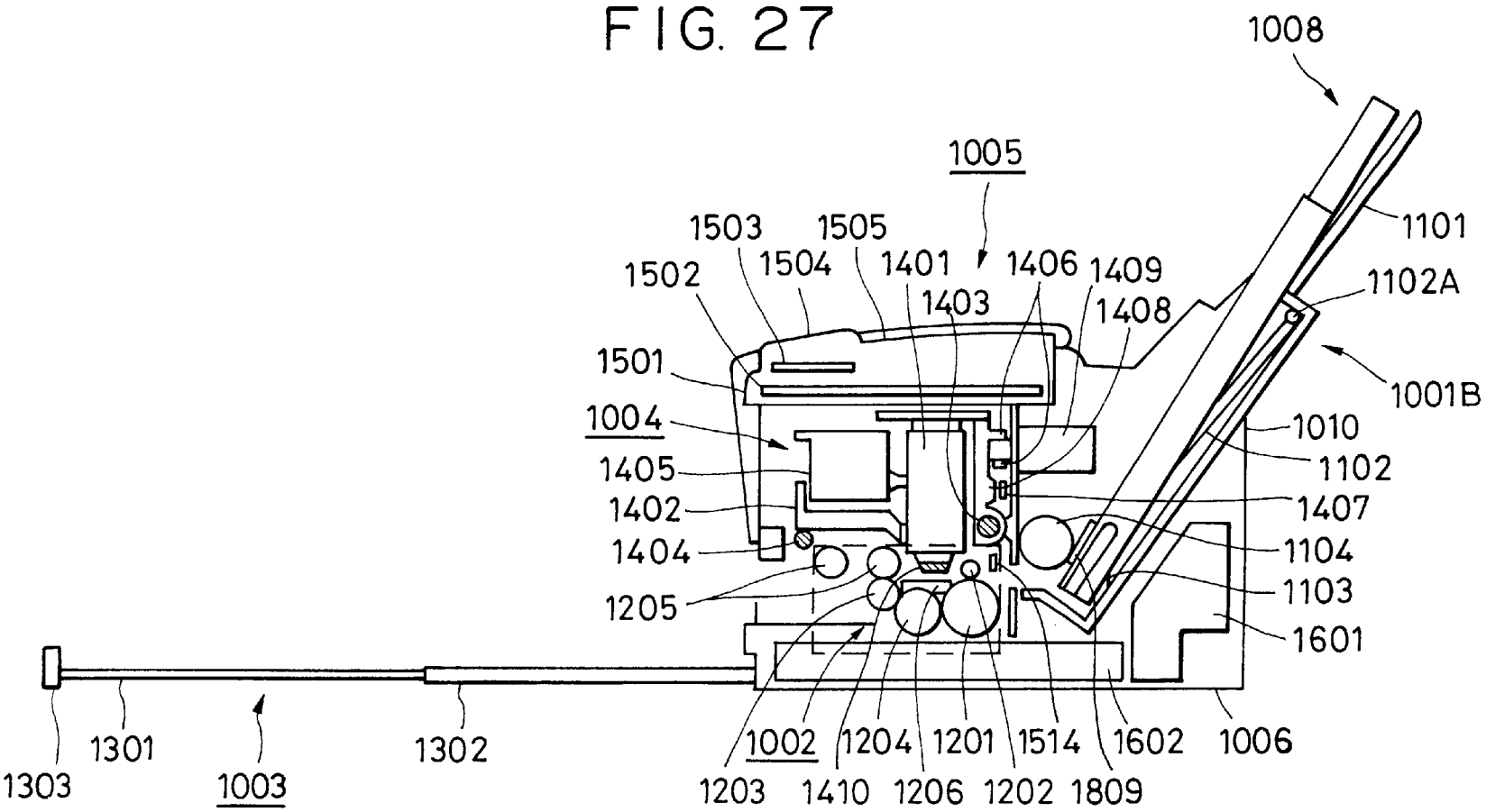
FIG. 27 is a sectional view of the recording apparatus in a state where the sheet pack shown in FIG. 24 is set onto the recording apparatus.

Next, the supply rollers 1104 are cleaned by driving the feed motor 1207 which serves as moving means in the cleaning operation. Specifically, the feed motor 1207 is driven to move the pressure plate 1102 of the automatic supply section 1001 toward the supply rollers 1104, thereby bringing the cleaning members 1809 on the sheet pack 1008 into pressure contact with the supply rollers 1104 through the pressure plate 1102, as shown in FIG. 27, while the supply rollers 1104 are rotated (S329). With the supply rollers 1104 rotated in a predetermined amount, the operation of cleaning the supply rollers 1104 is carried out. In this embodiment, the supply rollers 1104 are rotated twice for the cleaning operation, as much as double the amount by which the supply rollers 1104 are rotated for the operation of supplying each sheet.

After the cleaning of the supply rollers 1104, the MPU informs through the host computer, etc. that there is no sheet in the sheet pack 1008 (S330), and prompts, for example, exchange of the sheet pack 1008, thereby ending the sequence of operation steps.

With this fifth embodiment, as described above, since the cleaning members 1809 for cleaning the supply rollers 1104 are provided on the sheet pack 1008 and the operation of cleaning the supply rollers 1104 is performed at the predetermined timing, a deterioration in sheet supply capability of the supply rollers 1104 can be prevented. Also, since the timing to effect the cleaning operation of the supply rollers 1104 is set depending on the number of sheets contained in the sheet pack 1008, the cleaning operation of the supply rollers 1104 can be performed optimally depending on the number of recorded sheets.

In the fifth embodiment described above, the cleaning operation of the supply rollers 1104 is performed when the sheets contained in the sheet pack 1008 set in place are all used up. In addition, it is also possible to effect the cleaning operation of the supply rollers 1104 upon the user applying an instruction through the control panel of the host computer, the recording apparatus, etc., or to set the number of recorded sheets, at which the cleaning operation of the supply rollers 1104 should be effected, depending on the nature of sheet contained in the sheet pack 1008 so that the cleaning operation is performed in units of certain number of sheets. In such a case, this embodiment can be more preferably practiced by holding information about the number of recorded sheets, at which the cleaning operation of the supply rollers 1104 should be effected, in the bar code put on the sheet pack 1108.

As described above, the present invention can provide the following advantages. Since the sheet pack prepared by containing a predetermined number of sheets of printing paper therein beforehand is set onto the printer, the user can simply set sheets of printing paper to the printer without suffering inconvenience that has been experienced conventionally from the necessity of opening a package containing sheets of printing paper and taking out some of the sheets. Also, in the case of changing the type of sheets, the user can easily set the desired type of sheets by exchanging the sheet pack itself. Further, since the sheets of printing paper are stored in the sheet pack, there is no fear that finger prints may be put on the sheets, or the sheets may be stained or folded.

By using as materials to form the outer casing or frame of the sheet pack, it is possible to provide an inexpensive sheet pack.

The printer has such a structure that when the sheet pack is set onto the printer, the sheet supply opening and the abutment openings are automatically opened, and when the sheet pack is removed from the printer, those openings are automatically closed. Therefore, when the sheet pack is not set onto the printer, the sheet pack is kept in a more positively enclosed state, which is suitable in storing the sheets of printing paper in better condition.

An information recording member for recording information about the sheets of printing paper contained in the sheet pack, e.g., the quality, size, orientation, color, thickness, and number of sheets contained, is provided on the sheet pack, and means for reading the information from the recording member is provided on the printer. It is therefore possible to read the information about the sheets of printing paper contained in the sheet pack by the printer, and to display the read information on the display of the host PC or printer. As a result, the user can judge, e.g., whether the quality, size, orientation, and number of sheets contained in the sheet pack, which is set onto the printer, are fit for the properties of desired printing-out. This is advantageous in, for example, enabling the user to make printing on sheets having the desired size and quality in desired number.

The printer driver software installed in the host PC can receive the information read by the printer, and can automatically select printing setting optimum for, e.g., the quality and size of sheets in accordance with the received information.

By providing means enabling the printer to record information in the information recording member on the sheet pack, and a recording a result obtained by subtracting the number of sheets printed out from the number of sheets given by the originally read information, the latest information about the number of sheets is always recorded, and the information about the number of sheets read by the information recording member is not the number of sheets originally contained in the sheet pack, but the number of sheets remained at that time. From the information displayed on the display unit, therefore, the user can know the number of sheets of printing paper remained in the sheet pack. If the number of sheets remained is less than the number of sheets to be printed, the user can start printing after exchanging the sheet pack with another one, preferably new. It is hence possible to avoid the sheets from being depleted during the printing.

In addition, it is possible to store the setting information of the printer driver software, the name of the printer, the name of the host PC, etc. which are employed when some sheet pack is set. This is advantageous in that, when using such a sheet pack again, the user can easily make setting of the printer driver software, and know the name of the printer, the name of the host PC, etc. which were employed the last time.

What is claimed is:

1. A print system comprising:

attachment means onto which is a set a sheet pack, the sheet pack containing a predetermined number of sheets of printing paper and having an information recording member recording information about the sheets of printing paper, the sheet pack having pressure contact openings, and the sheet pack being so constructed as to open automatically upon insertion into the print system;

information reading means for reading the information recorded in said information recording member when said sheet pack is set onto said attachment means;

sheet supply means for supplying printing paper by contacting printing paper from said pressure contact openings; and display means for displaying the information read by said information reading means.

2. A print system according to claim 1, wherein said sheet pack is structured so as to be openable manually as well as automatically.

3. A print system comprising:

an attachment stand removably holding a sheet pack, the sheet pack containing a predetermined number of sheets and including an information recording member recording information about the sheets contained in said sheet pack is, the sheet pack having pressure contact openings, and the sheet pack being so constructed as to open automatically upon insertion into the print system;

an information reader for reading the information recorded in said information recording member;

sheet supply means for supplying the printing paper by contacting printing paper from said pressure contact openings;

printing means form printing an image on the sheet supplied form said sheet supply means; and display means for displaying the information read by said information reader.

4. A print system according to claim 3, wherein said sheet pack is structured so as to be openable manually as well as automatically.

5. A print system comprising:

an attachment stand removably holding a sheet pack, the sheet pack containing a predetermined number of sheets and including an information recording member recording information about the sheets contained in said sheet pack is, the sheet pack having pressure contact openings;

an information reader for reading the information recorded in said information recording member;

sheet supply means for supplying the printing paper by contacting printing paper from said pressure contact openings; and printing means for printing an image on the sheet supplied from said sheet supply means, wherein said sheet pack has an outer casing operable to open and close, and said outer casing is structured such that said outer casing, if not already open, is automatically opened upon said sheet pack being set onto said attachment stand.

6. A print system according to claim 5, wherein said outer casing of said sheet pack is made of thick paper.

7. A print system according to claim 5, wherein said outer casing is structured so as to be openable manually as well as automatically.

8. A print system according to claim 5, wherein said outer casing is structured so as close automatically upon said sheet pack being removed from said attachment stand.

* * * * *

UNITED STATES PATENT AND TRADEMARK OFFICE

CERTIFICATE OF CORRECTION

PATENT NO. : 6,651,975 B2
DATED : November 25, 2003
INVENTOR(S) : Kuniaki Ohstuka et al.

It is certified that error appears in the above-identified patent and that said Letters Patent is hereby corrected as shown below:

Column 3,
Line 39, “shown-in” should read -- shown in --.

Column 14,
Lines 18 and 41, “opening/-closing” should read -- opening/closing --.

Column 15,
Line 29, “opening are” should read -- openings are --.

Column 21,
Line 31, “member hatches” should read -- member. Latches --.

Column 24,
Line 1, “a recording a” should read -- recording a --;
Line 51, pack is,” should read -- pack, --;
Line 60, “form” should read -- for --; and
Line 61, “form” should read -- from --.

Column 25,
Line 6, “pack is,” should read -- pack, --.

Signed and Sealed this

Sixteenth Day of November, 2004

JON W. DUDAS
*Director of the United States Patent and Trademark Office*